US012791287B1

(12) United States Patent
Dandrow

(10) Patent No.: US 12,791,287 B1
(45) Date of Patent: Nov. 10, 2026

(54) SYSTEM AND METHODS FOR USING A MULTI-CONFIGURATION LASER CARTRIDGE TO TRAIN WITH A FIREARM

(71) Applicant: Strikeman USA, Inc., Cincinnati, OH (US)

(72) Inventor: Jonathan Dandrow, Cincinnati, OH (US)

(73) Assignee: Strikeman USA, Inc., Cincinnati, OH (US)

( * ) Notice: Subject to any disclaimer, the term of this patent is extended or adjusted under 35 U.S.C. 154(b) by 499 days.

(21) Appl. No.: 18/349,755

(22) Filed: Jul. 10, 2023

(51) Int. Cl.
*F41G 3/26* (2006.01)

(52) U.S. Cl.
CPC ..... *F41G 3/2655* (2013.01)

(58) Field of Classification Search
CPC ..... F41G 3/2655
See application file for complete search history.

(56) References Cited

U.S. PATENT DOCUMENTS

2019/0353457 A1* 11/2019 Northrup ..... G01S 5/16

OTHER PUBLICATIONS

SIRTNextLevelTraining, Screen Captures from YouTube Video dated Jan. 20, 2018; https://www.youtube.com/watch?v=-ySr-DnYkcY &t=3s.

Quantum XG 9MM—G-Sight Web Advertisement dated Mar. 20, 2023; http://web.archive.org/web/20230320221313/https://g-sight.com/collections/laser-trainers/products/quantum-sg-9mm.

* cited by examiner

*Primary Examiner* — Robert P Bullington
(74) *Attorney, Agent, or Firm* — Wood Herron & Evans LLP

(57) ABSTRACT

A method of supporting a training session of a firearm. The method includes capturing video data of a target during the training session and determining one or more locations of the target that are illuminated by light released from a laser cartridge of the firearm. The method further includes receiving reference position data and motion data from the laser cartridge of the firearm. The method further includes determining, based on the reference position data and the motion data, a targeting path representing movement of the firearm between an initial position and a target-facing position. The method further includes providing, for display on one or more user interfaces: a graphical representation of the one or more locations of the target that are illuminated by the light released from the laser cartridge, and a graphical representation of the targeting path of the firearm.

7 Claims, 22 Drawing Sheets

SYSTEM AND METHODS FOR USING A MULTI-CONFIGURATION LASER CARTRIDGE TO TRAIN WITH A FIREARM

TECHNICAL FIELD

The present invention relates generally to systems and methods of using a firearm training system, and more particularly to using a firearm training system that allows a multiple-configuration laser cartridge to be placed into a firearm and used during training exercises. The laser cartridge may be used in conjunction with an application that provides software-based training services, such as by collecting data associated with the use of the firearm during training exercises and providing feedback based on the use.

BACKGROUND

A firearm is a device designed to launch projectiles at high velocities through the controlled explosion of gunpowder. Typically, a firearm includes a barrel, a chamber, a trigger, a firing pin, and a cartridge. When a user pulls the trigger, the firing pin strikes a primer on the cartridge. This ignites the gunpowder inside the cartridge, causing the projectile to be pushed out of the barrel at high velocities.

Firearm training is a crucial part of firearm ownership and usage. It is essential for a firearm owner to be able to use the firearm safely and effectively. Training often includes developing skills such as marksmanship, gun handling, and situational awareness. For example, a user can learn marksmanship principles such as proper sight alignment, breath control, trigger control, and/or the like.

One problem faced by firearm owners is that it is expensive to train at a facility such as a shooting range, as ammunition has to be purchased each time the firearm owner participates in a training session. One solution has been to create training firearms that are designed specifically for practicing. For example, training firearms have been created that utilize a laser in place of ammunition, such that ammunition can be saved while engaging in a training session. However, the training firearm is a separate weapon, not capable of discharging live ammunition. This prevents the firearm owner from training using his or her real firearm. The training firearm may have a different look or feel, may have a different weight, and may not accurately simulate the "kickback" that occurs when a real firearm is discharged.

Another problem faced by firearm owners is the lack of availability of training facilities and qualified instructors. This may result in a firearm owner not being properly trained with the use of his or her firearm or may result in the firearm owner developing poor technique or form when training without a qualified instructor.

It is an object of the invention to mitigate or overcome some or all of the problems described above.

SUMMARY

In an aspect of the invention, a method of supporting a training session of a firearm is disclosed. The method includes capturing, by a computing device, video data of a target during the training session, wherein the video data depicts one or more locations of the target that are illuminated by a light released from a laser cartridge of the firearm. The method further includes determining, by the computing device and by processing the video data, the one or more locations of the target that are illuminated by the light released from the laser cartridge. The method further includes receiving, by the computing device, reference position data and motion data from the laser cartridge of the firearm, wherein the reference position data indicates a reference position of the firearm, and the motion data is indicative of a change in position over time relative to the reference position. The method further includes determining, by the computing device, a targeting path representing movement of the firearm between an initial position and a target-facing position, wherein the targeting path is determined based on the reference position data and the motion data. The method further includes providing, for display on one or more user interfaces of the computing device: a graphical representation of the one or more locations of the target that are illuminated by the light released from the laser cartridge, and a graphical representation of the targeting path of the firearm.

In an embodiment of the invention, prior to receiving the reference position data and the motion data, the method further includes establishing a Bluetooth communication session with the laser cartridge. In this embodiment, when receiving the reference position data and the motion data, the method includes receiving the reference position data and the motion data as part of the Bluetooth communication session.

In another embodiment of the invention, the method further includes comparing targeting path data identifying the targeting path and stored targeting path data identifying one or more configured targeting paths. The method further includes identifying one or more differences between characteristics of the targeting path and corresponding characteristics of the one or more configured targeting paths. The method further includes determining draw form feedback based on the one or more differences. The method further includes providing a graphical representation of the draw form feedback for display on one of the one or more user interfaces.

In another embodiment of the invention, the method further includes receiving handle grip data identifying a force applied to one or more locations on a handle of the firearm, wherein the force applied to the handle is measured over time by a sensor coupled to the handle. The method further includes comparing the handle grip data and stored handle grip data for one or more configured handle grips, the stored handle grip data including handle grip values identifying one or more forces to apply to handles of firearms. The method further includes determining grip feedback based on comparing the handle grip data and the handle grip safety data. The method further includes providing a graphical representation of the grip feedback for display on one of the one or more user interfaces of the computing device.

In another embodiment of the invention, the method further includes receiving trigger data that identifies at least one of: a force applied to the trigger of the firearm, or a speed at which a trigger of the firearm is pulled. The method further includes comparing the trigger data and stored trigger data identifying at least one of: a configured force to apply to the trigger, or a configured speed at which to pull the trigger. The method further includes determining trigger feedback based on comparing the trigger data and the stored trigger data. The method further includes providing a graphical representation of the trigger feedback for display on one of the one or more user interfaces of the computing device.

In another embodiment of the invention, the laser cartridge is configured with multiple configurations including a first configuration causing a laser diode to emit light for a first duration and a second configuration causing the laser diode to emit light for a second duration that is different than the first duration. In this embodiment, the graphical representation of the one or more locations of the target that are illuminated by the light released from the laser cartridge depicts a first set of one or more locations illuminated by light that corresponds to the first configuration and a second set of one or more locations illuminated by light that corresponds to the second configuration.

In another embodiment of the invention, the method further includes providing, to a server device, a request for one or more coaches or trainers capable of providing firearm training instruction, the request including location data of the computing device. The method further includes receiving referral data identifying the one or more coaches or trainers from the server device.

In another embodiment of the invention, the training session is a group training session. In this embodiment, the method further includes providing individual performance data to a server device, wherein the individual performance metric data is based on data identifying the one or more locations of the target that are illuminated by the light released from the laser cartridge, and path data identifying the targeting path. The method further includes receiving group performance data from the server device, the group performance data including at least one of: data identifying one or more group performance metrics for a plurality of computing devices participating in the group training session, or data identifying ranked individual performance metrics for the plurality of computing devices participating in the group training session. The method further includes providing, for display on one of the one or more user interfaces of the computing device, a graphical representation of the group performance data.

In another aspect of the invention, a laser cartridge includes a motion sensor, a laser diode, a memory, a processor, and a power source. The motion sensor is configured to measure an acceleration of the laser cartridge or an acceleration of a firearm to which the laser cartridge is attached. The laser diode is configured to emit light. The processor is operably coupled to the memory and configured to: communicate with the motion sensor, communicate with the laser diode such that the laser diode emits a burst of light, and communicate with one or more external devices. The power source is configured to provide power to the motion sensor, the laser diode, the memory, and the processor.

In another embodiment of the invention, the processor, when executing one or more instructions to communicate with the laser diode, is configured to communicate with the laser diode at a first time such that the laser diode emits the burst of light for a first duration, and communicate with the laser diode at a second time such that the laser diode emits another burst of light for a second duration that is different than the first duration.

In another embodiment of the invention, the processor, when executing one or more instructions to communicate with the one or more external devices, is configured to communicate with the one or more external devices via a Bluetooth communication session. In another embodiment of the invention, the motion sensor is an accelerometer.

In another embodiment of the invention, the processor, when executing one or more instructions to communicate with the one or more external devices, is configured to communicate with a sensor coupled to a handle of the firearm and communicate with a sensor coupled to a trigger of the firearm.

In another embodiment of the invention, the power source includes one or more rechargeable energy-storing devices that are configured for wireless charging.

In another embodiment of the invention, the laser cartridge and a wireless charging station are part of a laser cartridge system.

In another aspect of the invention, a method of supporting a training session of a firearm is disclosed. The method includes measuring, using a motion sensor of a laser cartridge positioned in the firearm, a reference position of the firearm and a change in position over time relative to the reference position. The method further includes releasing, using a laser diode of the laser cartridge, one or more bursts of light toward a target. The method further includes transmitting, from a processor of the laser cartridge to a computing device, reference position data indicating the reference position and motion data indicating the change in position over time, wherein the reference position data and the motion data are transmitted via a communication session between the laser cartridge and the computing device, and wherein transmitting the reference position data and the motion data permits the computing device to determine a targeting path and to provide a graphical representation of the targeting path for display on a user interface.

In another embodiment of the invention, the communication session is a Bluetooth communication session.

In another embodiment of the invention, releasing the one or more bursts of light toward the target includes releasing a first burst of light for a first duration, and releasing a second burst of light for a second duration that is different from the first duration, wherein the first duration corresponds to a first configuration of the laser cartridge and the second duration corresponds to a second configuration of the laser cartridge.

In another embodiment of the invention, the method further includes receiving, by the processor of the laser cartridge, signals representative of a force applied to one or more locations on a handle of the firearm, wherein the force applied to the one or more locations on the handle is measured by a sensor of the firearm. The method further includes transmitting, via the communication session and to the computing device, handle grip data that identifies the force applied to the one or more locations on the handle.

In another embodiment of the invention, the method further includes receiving, by the processor of the laser cartridge, signals representative of at least one of: a force applied to the trigger of the firearm, or a speed at which a trigger of the firearm is pulled. The method further includes transmitting, via the communication session and to the computing device, trigger data that identifies at least one of: the force applied to the trigger of the firearm, or the speed at which the trigger of the firearm is pulled.

The above summary presents a simplified overview of some embodiments of the invention to provide a basic understanding of certain aspects of the invention discussed herein. The summary is not intended to provide an extensive overview of the invention, nor is it intended to identify any key or critical elements or delineate the scope of the invention. The sole purpose of the summary is merely to present some concepts in a simplified form as an introduction to the detailed description presented below.

BRIEF DESCRIPTION OF THE DRAWINGS

The accompanying drawings, which are incorporated in and constitute a part of this specification, illustrate various embodiments of the invention and, together with the general description of the invention given above, and the detailed description of the embodiments given below, serve to explain the embodiments of the invention.

The appended drawings are not necessarily to scale and may present a somewhat simplified representation of various features illustrative of the basic principles of the invention. The specific design features of the sequence of operations as disclosed herein, including, for example, specific dimensions, orientations, locations, and shapes of various illustrated components, may be determined in part by the intended application and use environment. Certain features of the illustrated embodiments may have been enlarged or distorted relative to others to facilitate visualization and a clear understanding.

DETAILED DESCRIPTION

The following detailed description of example embodiments refers to the accompanying drawings that show, by way of illustration, specific details and embodiments in which the invention may be practiced. These embodiments are described in sufficient detail to enable those skilled in the art to practice the invention. Other embodiments may be implemented, and structural, logical, and electrical changes may be made without departing from the scope of the invention as defined in the appended claims.

Figure 1:
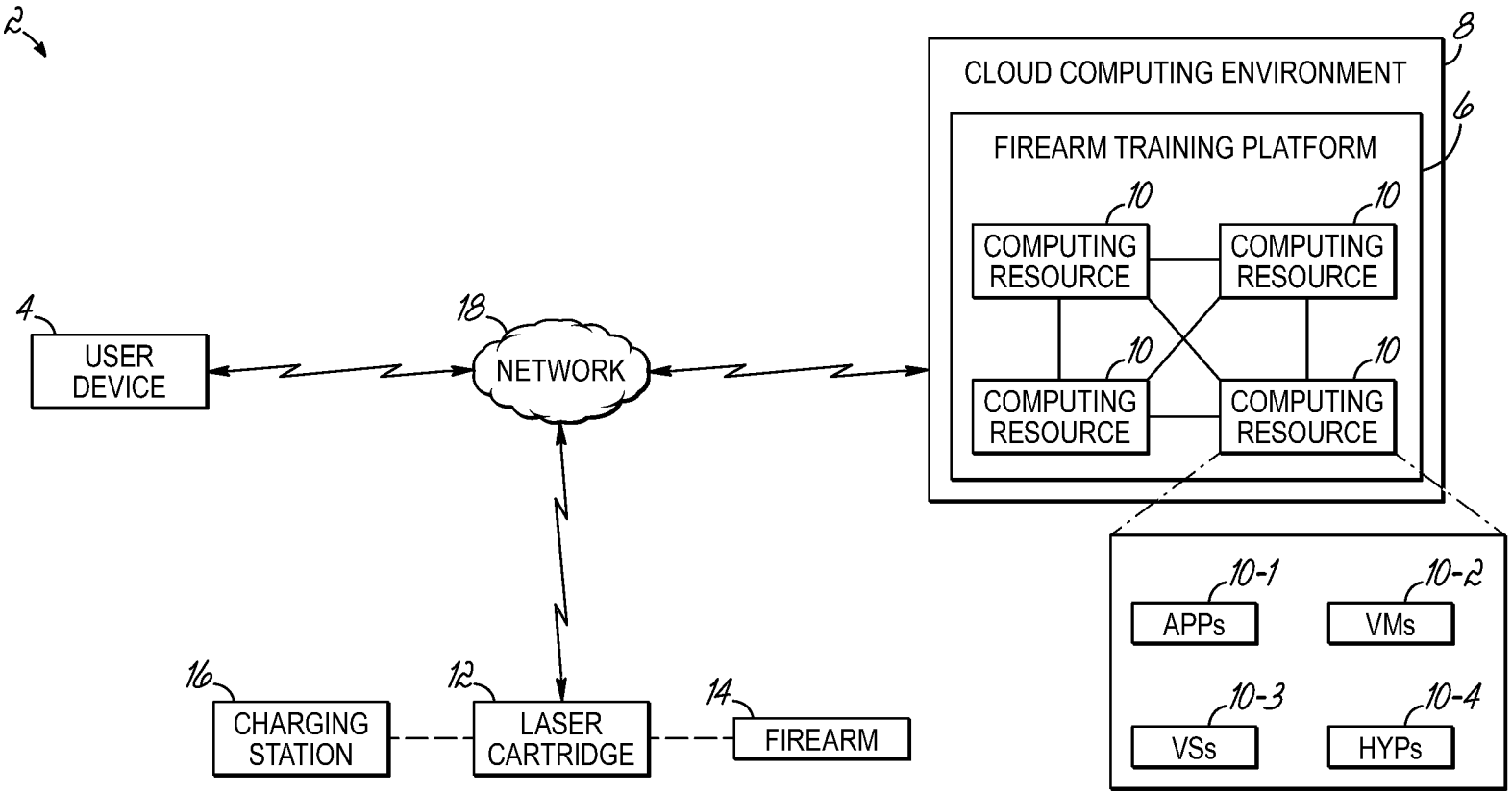
FIG. 1 is a diagram of an example environment in which systems and/or methods described herein may be implemented.

FIG. 1 is a diagram of an example environment 2 in which systems and/or methods described herein may be implemented. As shown in FIG. 1, environment 2 may include a computing device 4, a firearm training platform 6 supported within a cloud computing environment 8 (e.g., using computing resources 10), a laser cartridge 12, a firearm 14, a charging station 16, and/or a network 18. Devices of environment 2 may interconnect via wired connections, wireless connections, or a combination of wired and wireless connections.

Computing device 4 includes one or more devices capable of receiving, generating, storing, processing, and/or providing information associated with a firearm training session. Computing device 4 may include a computing device, such as a mobile phone (e.g., a smart phone, a radiotelephone, etc.), a tablet computer (e.g., an iPad, etc.), a laptop computer, a handheld computer, a server computer, a gaming device, a wearable communication device (e.g., a smart wristwatch, a pair of smart eyeglasses, etc.), or a similar type of device.

In some embodiments, computing device 4 may support a firearm training application. The firearm training application may be used to improve the marksmanship and/or form of a user when training with the firearm 14. For example, the user may discharge the firearm 14 at a target during a training session, and the computing device 4 may capture video data of the target during the training session. The video data may, for example, depict the target and locations on the target which are illuminated when struck by light emanating from the laser cartridge 12. In some embodiments, the computing device 4 may process the video data to determine the accuracy of the user. In some embodiments, the computing device 4 may determine shot metrics and/or shot feedback based on the video data.

In some embodiments, the computing device 4 may establish a communication session with the laser cartridge 12. The communication session may be a Bluetooth communication session (e.g., a Bluetooth low energy (BLE) communication session, etc.) and/or another type of near-field (NF) communication. By establishing the Bluetooth communication session, the computing device 4 may receive measured sensor data from the laser cartridge 12 and/or any other component capable of sending and/or receiving data. The measured sensor data may include reference position data indicating a position of the firearm 14 (i.e., a position of the laser cartridge 12 while resting in the chamber of the firearm 14), motion data indicative of a change in position over time relative to the reference position, handle grip data, trigger data, and/or the like. The computing device 4 may process this data and may update one or more user interfaces to display the measured sensor data, related metrics data, and/or related feedback data.

Firearm training platform 6 includes one or more devices capable of receiving, storing, processing, and/or providing information associated with a firearm training session. Firearm training platform 6 may include a server device (e.g., a host server, a web server, an application server, etc.), a data center device, or a similar device.

In some embodiments, the firearm training platform 6 may support communications between multiple computing devices 4. For example, the firearm training platform 6 may receive data from multiple computing devices 4, may process the received data, and/or may determine one or more performance metrics associated with a competition or joint training session involving two or more users. The one or more performance metrics may include one or more group performance metrics and/or one or more individual performance metrics that are capable of being ranked. These metrics may be provided to each respective computing device 2 for display on a user interface.

In some embodiments, the firearm training platform 6 may support a referrals system to provide a user with a recommended trainer. For example, the firearm training platform 6 may receive performance and/or feedback data from a computing device 4, and may recommend a particular coach or trainer based on the location of the user and the performance and/or feedback data. In some embodiments, such as when a local trainer is unavailable or inaccessible, the coach or trainer recommended may be able to provide training via remote communications.

In some embodiments, as shown, the firearm training platform 6 may be hosted in the cloud computing environment 8. Notably, while embodiments described herein describe the firearm training platform 6 as being hosted in the cloud computing environment 8, in some embodiments, the firearm training platform 6 may not be cloud-based (i.e., may be implemented outside of a cloud computing environment) or may be partially cloud-based. In some embodiments, one or more features or software services described as being performed by the firearm training platform 6 may be performed by another device, such as the computing device 4, the laser cartridge 12, or another device.

Cloud computing environment 8 includes an environment that hosts firearm training platform 6. Cloud computing environment 8 may provide computation, software, data access, storage, etc. services that do not require end-user knowledge of a physical location and configuration of system(s) and/or device(s) that hosts the firearm training platform 6. As shown, the cloud computing environment 8 may include a group of computing resources 10 (referred to collectively as "computing resources 10" and individually as "computing resource 10").

Computing resource 10 includes one or more personal computers, workstation computers, server devices, or another type of computation and/or communication device. In some embodiments, the computing resource 10 may host the firearm training platform 6. The cloud resources may include compute instances executing in the computing resource 10, storage devices provided in the computing resource 10, data transfer devices provided by the computing resource 10, and/or the like. In some embodiments, the computing resource 10 may communicate with other computing resources 10 via wired connections, wireless connections, or a combination of wired and wireless connections.

As further shown in FIG. 1, computing resource 10 may include a group of cloud resources, such as one or more applications (APPs) 10-1, one or more virtual machines (VMs) 10-2, virtualized storage (VSs) 10-3, one or more hypervisors (HYPs) 10-4, and/or the like.

Application 10-1 may include one or more software applications that may be provided to or accessed by the computing device 4 and/or the firearm training platform 6. Application 10-1 may eliminate a need to install and execute the software applications on these devices. In some embodiments, one application 10-1 may send/receive information to/from one or more other applications 10-1, via virtual machine 10-2. In some embodiments, application 10-1 may be a firearm training application. The firearm training application may include one or more user interfaces that, when displayed on the computing device 4, permit a user to configure a training session, participate in a training session, participate in a joint training session or competition, receive feedback on a training session or competition, receive recommendations on local or remote coaches or trainers, schedule training sessions with local or remote coaches or trainers, and/or the like.

Virtual machine 10-2 may include a software implementation of a machine (e.g., a computer) that executes programs like a physical machine. Virtual machine 10-2 may be either a system virtual machine or a process virtual machine, depending upon use and degree of correspondence to any real machine by virtual machine 10-2. A system virtual machine may provide a complete system platform that supports execution of a complete operating system ("OS"). A process virtual machine may execute a single program and may support a single process. In some embodiments, virtual machine 10-2 may execute on behalf of another device (e.g., computing device 4), and may manage infrastructure of the cloud computing environment 8, such as data management, synchronization, or long-duration data transfers.

Virtualized storage 10-3 may include one or more storage systems and/or one or more devices that use virtualization techniques within the storage systems or devices of the computing resource 10. In some embodiments, within the context of a storage system, types of virtualizations may include block virtualization and file virtualization. Block virtualization may refer to abstraction (or separation) of logical storage from physical storage so that the storage system may be accessed without regard to physical storage or heterogeneous structure. The separation may permit administrators of the storage system flexibility in how the administrators manage storage for end users. File virtualization may eliminate dependencies between data accessed at a file level and a location where files are physically stored. This may enable optimization of storage use, server consolidation, and/or performance of non-disruptive file migrations.

Hypervisor 10-4 may provide hardware virtualization techniques that allow multiple operating systems (e.g., "guest operating systems") to execute concurrently on a host computer, such as computing resource 10. Hypervisor 10-4 may present a virtual operating platform to the guest operating systems and may manage the execution of the guest operating systems.

Laser cartridge 12 includes one or more components capable of receiving, storing, processing, and/or providing information associated with a firearm training session. For example, laser cartridge 12 may include a printed circuit board (PCB) with a processor (e.g., a microprocessor, etc.), a motion sensor (e.g., an accelerometer, a gyroscope, etc.), an input/output component capable of enabling Bluetooth communications, and/or the like. Additional detail on the physical components of the laser cartridge 12 is provided further herein.

The laser cartridge 12 may be configured to emit light such that the light illuminates a target. In some embodiments, the laser cartridge 12 may have multiple configurations that vary the manner in which light illuminates the target. For example, the laser cartridge 12 may have a first configuration that causes a burst of light to illuminate the target for a short time period and a second configuration that causes a burst of light to illuminate the target for an extended time period.

Firearm 14 includes one or more components capable of discharging a projectile and/or light emanating from the laser cartridge 12. The firearm 14 may be a pistol, rifle, and/or another type of firearm. The firearm 14 may include a barrel, a chamber, a trigger, a firing pin, a cartridge, such as the laser cartridge 12, a frame (sometimes referred to as a handle or a stock), a safety, and/or the like. The laser cartridge 12 may be placed into the barrel of the firearm 14. When a user presses the trigger, the firing pin is launched into the backer of the laser cartridge 12, causing the laser cartridge 12 to emit light capable of illuminating a target. To the extent different types of firearms use different sizes of ammunition, it is to be understood that the laser cartridge 12 described herein may be modified to fit into each respective type of firearm.

In some embodiments, the firearm 14 may include a trigger sensor. The trigger sensor may include a strain gauge, a piezoelectric sensor, a sensor capable of measuring a force applied to the trigger (e.g., such as by measuring a change in resistance when the trigger is subjected to deformation or stress), and/or another type of sensing mechanism. Additionally, or alternatively, the firearm 14 may include a handle grip sensor. The handle grip sensor may include a strain gauge, a piezoelectric sensor, a sensor capable of measuring a force applied to the handle (e.g., thin metal wires or foils of a strain gauge may be bonded to the surface of the handle and resistance of the wires may change when the handle is stressed, compressed, gripped, etc.).

Charging station 16 includes one or more components capable of charging energy-storing devices such as batteries. For example, charging station 16 may include a base to support a charging mechanism, a charging pad to support the energy-storing devices, a transmitter coil within the base, and a receiver coil that is part of the charging pad. The base may connect to a power source, such as a wall outlet or similar power source. The base unit may include circuitry capable of converting AC power into the DC power used to charge the energy-storing devices. The transmitter coil may be used to generate an electromagnetic field used to transfer power wirelessly to the receiver coil of the charging pad. For example, the electromagnetic field may cause electromagnetic signals to be provided to the receiver coil, and the receiver coil may convert the electromagnetic signals into electrical energy used to charge the energy-storing devices.

Network 18 includes one or more wired and/or wireless networks. For example, network 18 may include a cellular network (e.g., a fifth generation (5G) network, a fourth generation (4G) network, such as a long-term evolution (LTE) network, a third generation (3G) network, and/or a code division multiple access (CDMA) network), a public land mobile network (PLMN), a local area network (LAN), a wide area network (WAN), a metropolitan area network (MAN), a telephone network (e.g., the Public Switched Telephone Network (PSTN)), a private network, an ad hoc network, an intranet, the Internet, a fiber optic-based network, a cloud computing network, or the like, and/or a combination of these or other types of networks.

The number and arrangement of devices and networks shown in FIG. 1 are provided as an example. In practice, there may be additional devices and/or networks, fewer devices and/or networks, different devices and/or networks, or differently arranged devices and/or networks than those shown in FIG. 1. Furthermore, two or more devices shown in FIG. 1 may be implemented within a single device, or a single device shown in FIG. 1 may be implemented as multiple, distributed devices. Additionally, or alternatively, a set of devices (e.g., one or more devices) of environment 2 may perform one or more functions described as being performed by another set of devices of environment 2.

Figure 2:
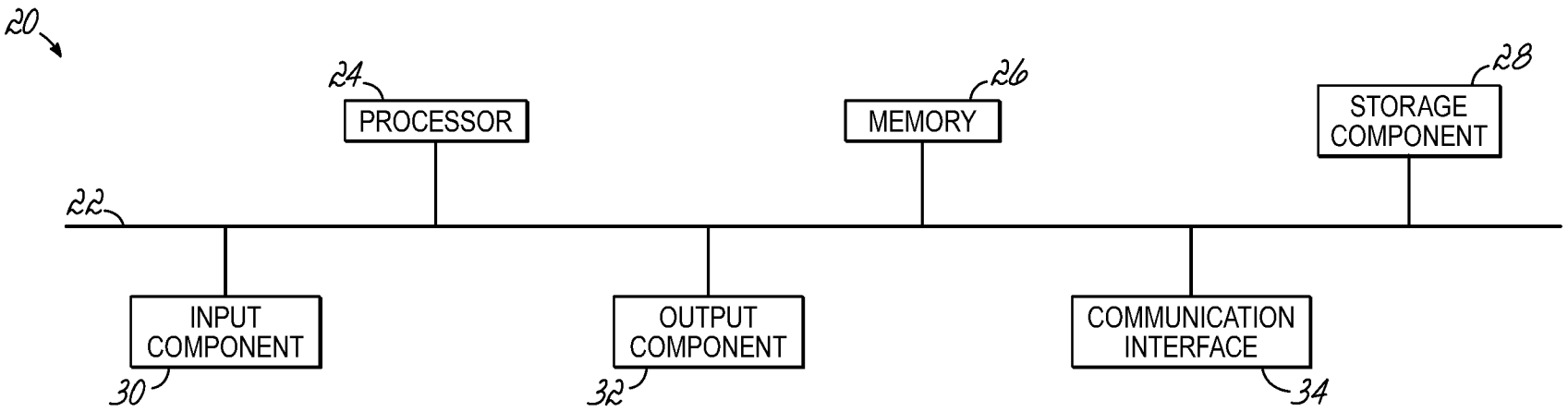
FIG. 2 is a diagram of example components of one or more devices of FIG. 1.

FIG. 2 is a diagram of example components of a device 20. Device 20 may correspond to the computing device 4, the firearm training platform 6, the laser cartridge 12, the firearm 14, the charging station 16, and/or any other device described herein. In some embodiments, the computing device 4, the firearm training platform 6, the laser cartridge 12, the firearm 14, and/or the charging station 16 may include one or more devices 20 and/or one or more components of device 20. As shown in FIG. 2, device 20 may include a bus 22, a processor 24, a memory 26, a storage component 28, an input component 30, an output component 32, and/or a communication interface 34.

Bus 22 includes a component that permits communication among multiple components of device 20. Processor 24 is implemented in hardware, firmware, and/or a combination of hardware and software. Processor 24 includes a microprocessor, a central processing unit (CPU), a graphics processing unit (GPU), an accelerated processing unit (APU), a microcontroller, a digital signal processor (DSP), a field-programmable gate array (FPGA), an application-specific integrated circuit (ASIC), and/or another type of processing component. In some embodiments, processor 24 includes one or more processors capable of being programmed to perform a function. Memory 26 includes a random-access memory (RAM), a read only memory (ROM), and/or another type of dynamic or static storage device (e.g., a flash memory, a magnetic memory, and/or an optical memory) that stores information and/or instructions for use by processor 24.

Storage component 28 stores information and/or software related to the operation and use of device 20. For example, storage component 28 may include a hard disk (e.g., a magnetic disk, an optical disk, a magneto-optic disk, and/or a solid-state disk), a compact disc (CD), a digital versatile disc (DVD), a floppy disk, a cartridge, a magnetic tape, and/or another type of non-transitory computer-readable medium, along with a corresponding drive.

Input component 30 includes a component that permits device 20 to receive information, such as via user input (e.g., a touch screen display, a keyboard, a keypad, a mouse, a button, a switch, and/or a microphone). In some embodiments, such as when device 20 corresponds to the laser cartridge 12, input component 30 may include a motion sensor, a location sensor, and/or another type of sensor. The motion sensor may include an inertial measurement unit (IMU), an accelerometer (e.g., a micro electro-mechanical system (MEMS) capacitive accelerometer, a piezoelectric accelerometer, an accelerometer designed to fit within the laser cartridge 12, etc.), a gyroscope, a magnetometer, an optical sensor, an ultrasonic sensor, a pressure sensor, and/or the like. In some embodiments, the motion sensor may be configured to measure acceleration in one or more directions and/or to detect changes in velocity, tilt, and/or vibration. The motion sensor may be configured generate electrical signals representative of measured sensor data and can send these signals to the processor 24. Output component 32 includes a component that provides output information from device 20 (e.g., a display, a speaker, and/or one or more light-emitting diodes (LEDs)).

Communication interface 34 includes a transceiver-like component (e.g., a transceiver and/or a separate receiver and transmitter) that enables device 20 to communicate with other devices, such as via a wired connection, a wireless connection, or a combination of wired and wireless connections. Communication interface 34 may permit device 20 to receive information from another device and/or provide information to another device. For example, communication interface 34 may include an Ethernet interface, an optical interface, a coaxial interface, an infrared interface, a radio frequency (RF) interface, a universal serial bus (USB) interface, a Wi-Fi interface, a cellular network interface, a Bluetooth communication interface, such as a Bluetooth low energy (BLE) interface, and/or the like.

Device 20 may perform one or more processes described herein. Device 20 may perform these processes based on processor 24 executing software instructions stored by a non-transitory computer-readable medium, such as memory 26 and/or storage component 28. A computer-readable medium is defined herein as a non-transitory memory device. A memory device includes memory space within a single physical storage device or memory space spread across multiple physical storage devices.

Software instructions may be read into memory 26 and/or storage component 28 from another computer-readable medium or from another device via communication interface 34. When executed, software instructions stored in memory 26 and/or storage component 28 may cause processor 24 to perform one or more processes described herein. Additionally, or alternatively, hardwired circuitry may be used in place of or in combination with software instructions to perform one or more processes described herein. Thus, embodiments described herein are not limited to any specific combination of hardware circuitry and software.

The number and arrangement of components shown in FIG. 2 are provided as an example. In practice, device 20 may include additional components, fewer components, different components, or differently arranged components than those shown in FIG. 2. Additionally, or alternatively, a set of components (e.g., one or more components) of device 20 may perform one or more functions described as being performed by another set of components of device 20.

Figure 3:
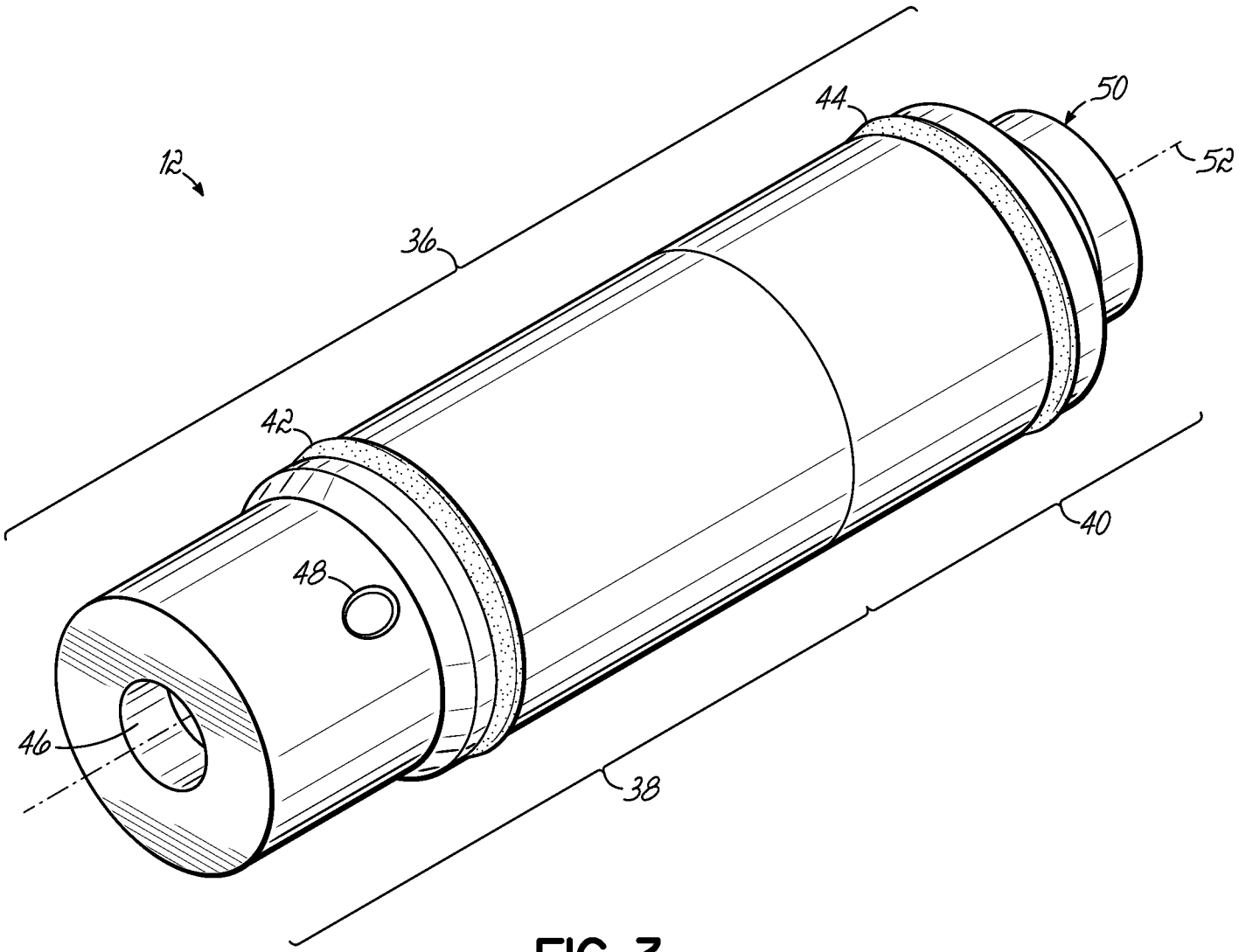
FIG. 3 is a diagram of a perspective view of a laser cartridge in accordance with the principles of the present disclosure.
Figure 4:
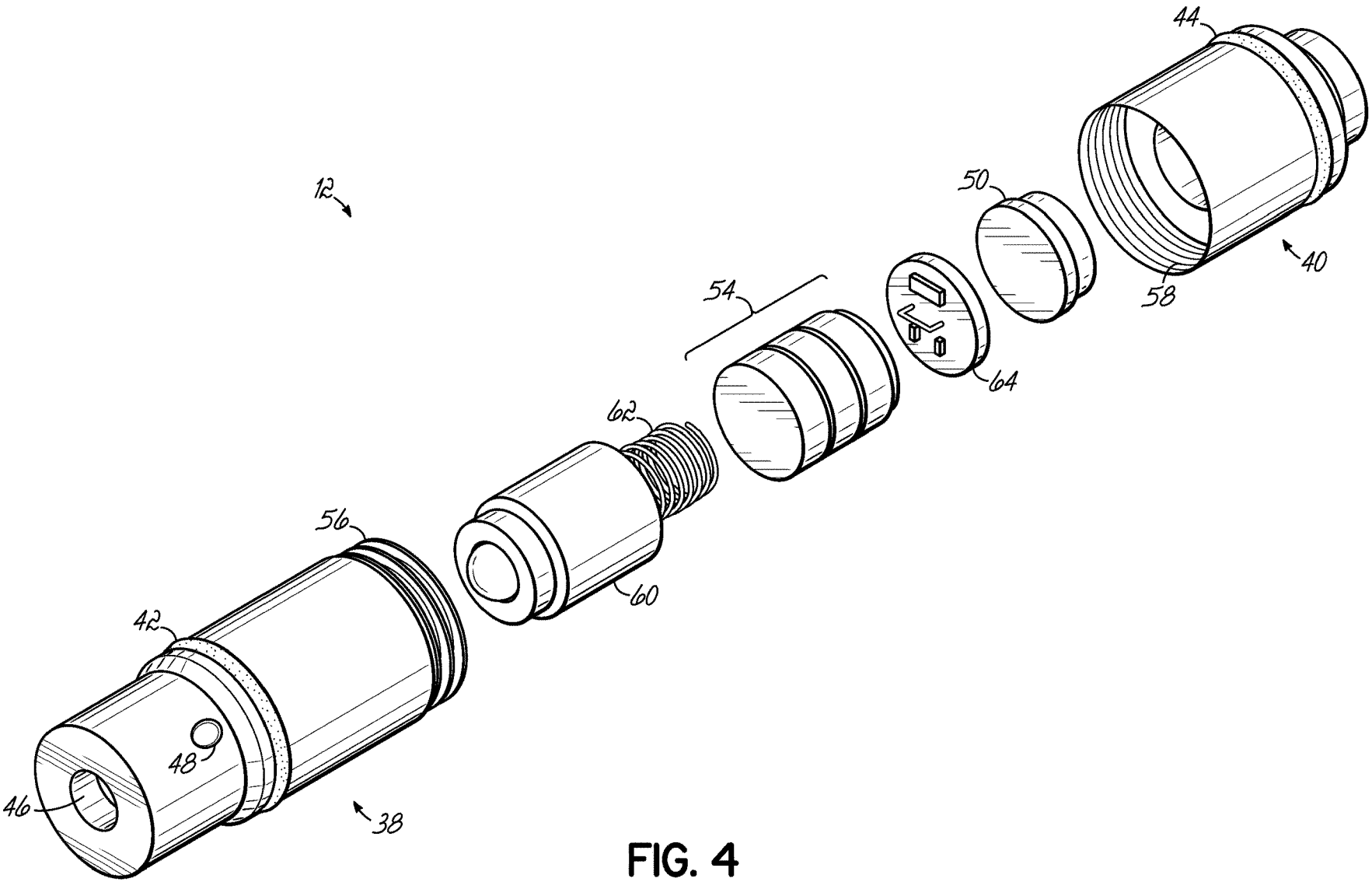
FIG. 4 is an exploded, perspective view of the laser cartridge.
Figure 5:
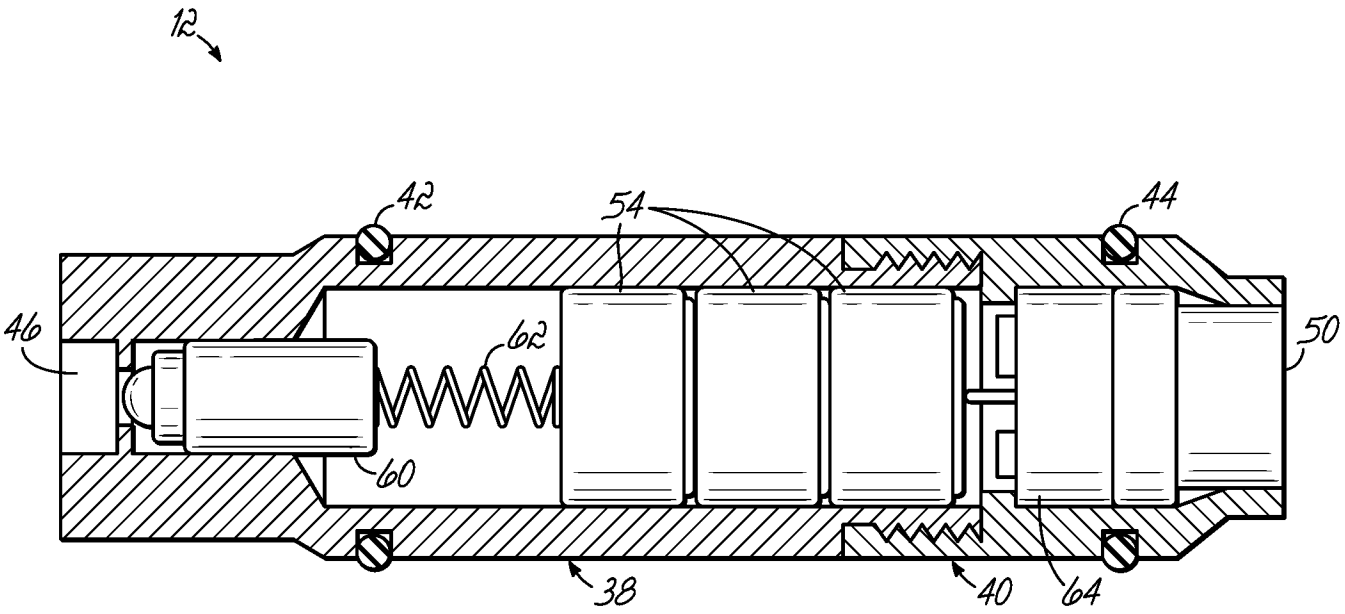
FIG. 5 is a cross-sectional view of the laser cartridge.

FIGS. 3-5 are diagrams of different views of the laser cartridge 12 in accordance with the principles of the present disclosure. FIG. 3 is a perspective view of the laser cartridge 12. The laser cartridge 12 may include a housing 36 that includes a first housing piece 38 and a second housing piece 40. Two O-rings 42, 44 are positioned in grooves in the housing 36. For example, O-ring 42 is positioned in a groove in the first housing piece 38 and O-ring 44 is positioned in a groove in the second housing piece 40. O-rings 42,44 can reduce vibration when a user activates the firing pin and/or can help ensure the laser cartridge 12 maintains a secure position within the chamber of the firearm 14. An exposed end of the first housing piece 38 may include an aperture 46 that allows light to emanate from the laser cartridge 12. The first housing piece 38 may include a set of apertures 48. An adjustment screw may be placed into an aperture 48 to adjust a position of a laser diode within the laser cartridge 12.

The end of the second housing piece 40 that is opposite the first housing piece 38 includes a backer 50 (not directly visible in FIG. 3). Backer 50 includes a padding to safely absorb the impact of the firing pin. The impact of the firing pin on the backer 50 can cause light to emanate from the laser cartridge 12 when a firearm is discharged, as will be shown further herein. In a preferred embodiment, the backer 50 is a rubber material or a similar type of material. In other embodiments, the backer 50 may be another type of material so long as the impact of the firing pin may be safely absorbed. Axis 52 is an axis of rotation that extends through a central point of the laser cartridge 12.

As can be seen in FIG. 3, the laser cartridge 12 is designed without rim. This prevents the laser cartridge 12 from being ejected from the firearm 14 (e.g., as would be the case with traditional ammunition).

FIG. 4 is an exploded, perspective view of the laser cartridge 12. The laser cartridge 12 includes the two O-rings 42, 44, the backer 50, a power supply 54, a threaded connector 56, an inversely threaded connector 58, a laser diode 60, a spring 62, and a printed circuit board (PCB) 64.

Power supply 54 may include a set of rechargeable energy-storing devices, such as batteries or a similar type of device. In a preferred embodiment, power is provided to the laser cartridge 12 by stacking three rechargeable batteries within the inside of the housing 36. For example, each respective battery can be stacked onto the spring 62 of the first housing piece 38. When the threaded connectors 56, 58 are connected, a battery opposite the spring 62 will contact the (PCB) 64, allowing power to be provided to the laser cartridge 12.

As shown, the threaded connector 56 is part of the first housing piece 38 and the inversely threaded connector 58 is part of the second housing piece 40. To connect the first housing piece 38 and the second housing piece 40, a user may place the threaded connector 56 up against the inversely threaded connector 58 and may rotate the first housing piece 38 or the second housing piece 40 such that teeth of the threaded connector 56 interlock with corresponding teeth of the inversely threaded connector 58.

Laser diode 60 is a semiconductor device that converts electrical energy into light energy. As will be described further herein, applying current to the laser diode 60 causes the laser diode 60 to emit light through the aperture 46. Spring 62 is a coil that allows the flow of current between the power supply 54 and the laser diode 60.

PCB 64 may include a processor, such as a microprocessor, a motion sensor (e.g., an accelerometer, a gyroscope, etc.), and any other circuitry needed to establish communications with external devices. For example, the PCB 64 may include circuitry needed to establish Bluetooth communications with nearby devices.

FIG. 5 is a cross-sectional view of the laser cartridge 12. To cause the laser cartridge 12 to emanate light (e.g., via the laser diode 60), pressure can be applied to the backer 50. If the laser cartridge 12 is not loaded into the firearm 14, this can be done by having a user press on the backer 50 with his or her hand. If the laser cartridge 12 is loaded into the firearm 14, this pressure can be applied by a firing pin when the user presses the trigger of the firearm 14. The pressure applied to the backer 50 allows the PCB 64 to contact the power supply 54. A sensor on the PCB 64 may detect the pressure applied to the backer 50 and may send a signal to a switch of the PCB 64 to cause the switch to enable the flow of current to the laser diode 60. Current flowing to the laser diode 60 (e.g., via the spring 62) causes the laser diode 60 to emanate light through aperture 46.

Figure 6:
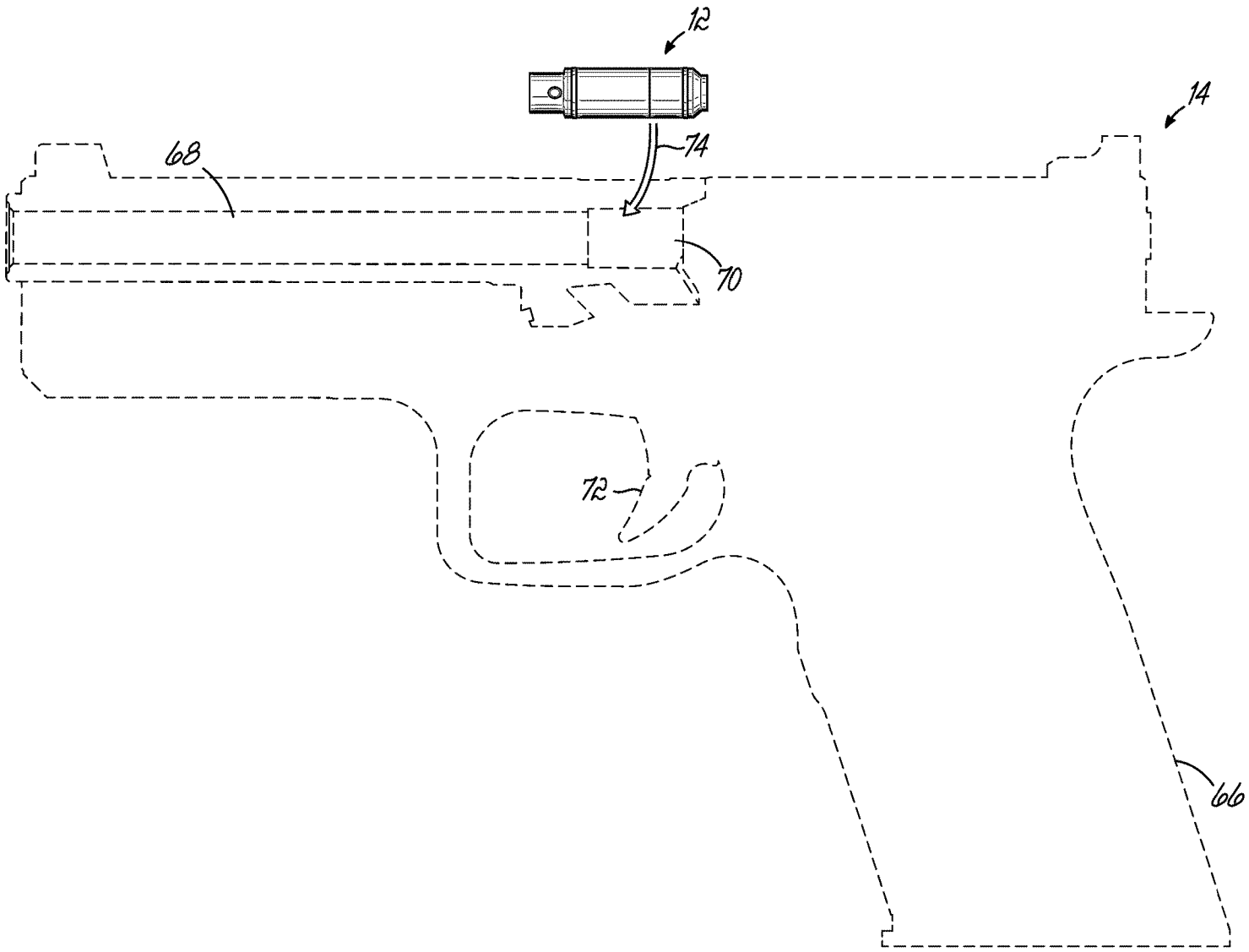
FIG. 6 is a diagram of the laser cartridge being placed into a firearm.

FIG. 6 is a diagram of the laser cartridge 12 being placed into a firearm 14. Firearm 14 may include a handle 66, a barrel 68 with a chamber 70, and a trigger 72. As shown by reference number 74, the laser cartridge 12 may be placed into the chamber 70. When a user presses the trigger 72, a firing pin is launched into the backer 50 of the laser cartridge 12. The impact enables the electrical connection between the PCB 64, power supply 54, and laser diode 60, causing light to emanate from the laser cartridge 12.

Figure 7:
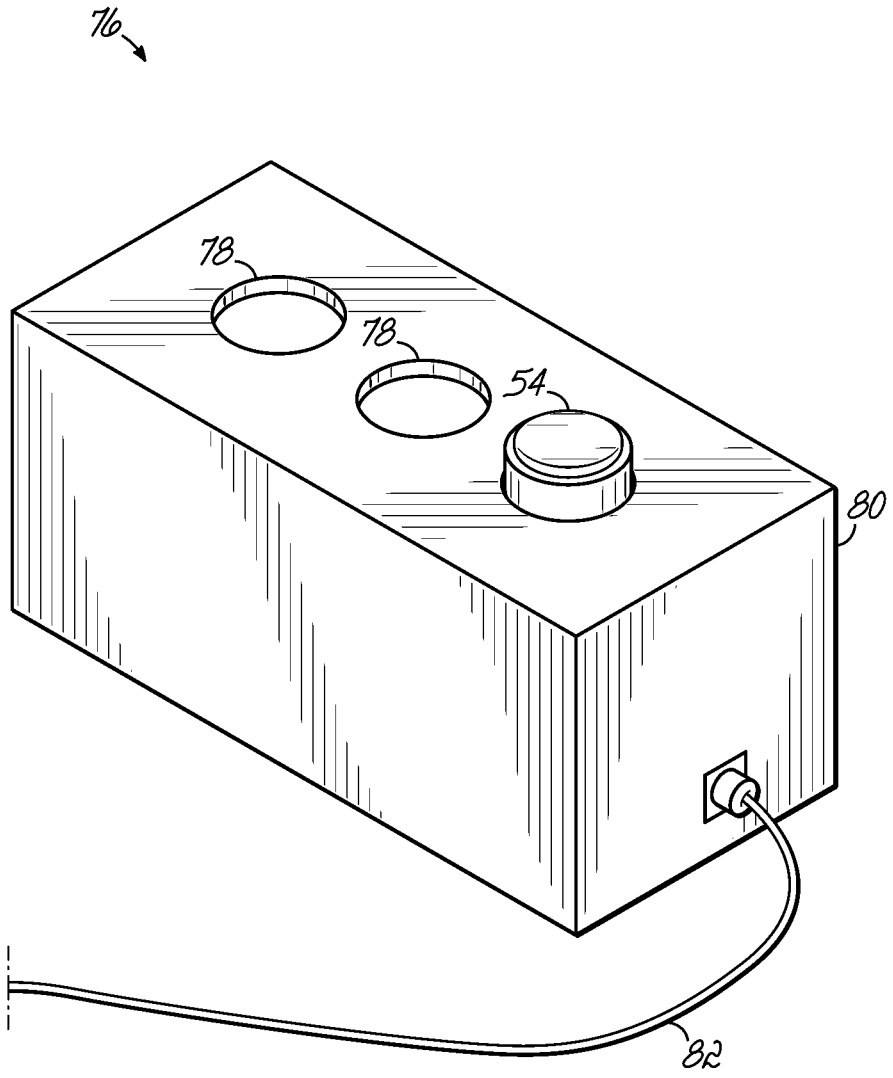
FIG. 7 is a diagram of a wireless charging station for the laser cartridge.

FIG. 7 is a diagram of a wireless charging station 76 for the laser cartridge 12. The wireless charging station 76 may include a set of charging pads 78, a base 80, and a charging cable 82. Energy-storing devices, such as batteries, may be recharged by placing each respective energy-storing device onto a corresponding charging pad 78. The charging cable 82 may be plugged into a power source such as a wall outlet. This allows power to be provided to the wireless charging station 76, such that the wireless charging station 76 holds a charge that can be used to charge the energy-storing devices wirelessly.

The inside of the base 80 may include circuitry capable of converting alternating current (AC) power into the direct current (DC) power used to charge the energy-storing devices. For example, a transmitter coil may be used to generate an electromagnetic field capable of transferring power wirelessly to a receiver coil of a charging pad 78. The receiver coil may convert the electromagnetic signals into electrical energy used to charge the energy-storing devices.

Figure 8A:
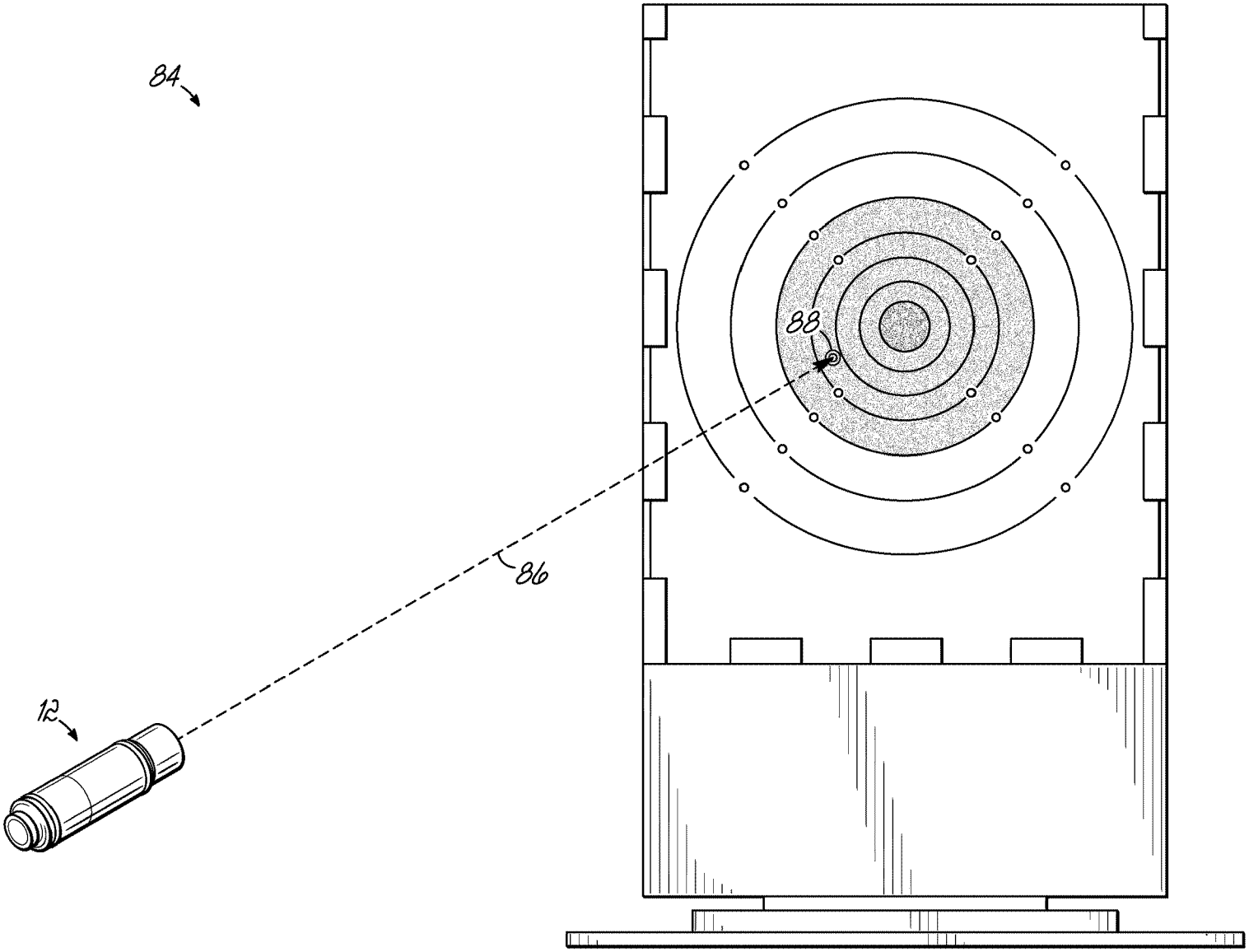
FIG. 8A is a diagram of a first configuration of the laser cartridge which causes a burst of light to illuminate a portion of a target for a short time period.
Figure 8B:
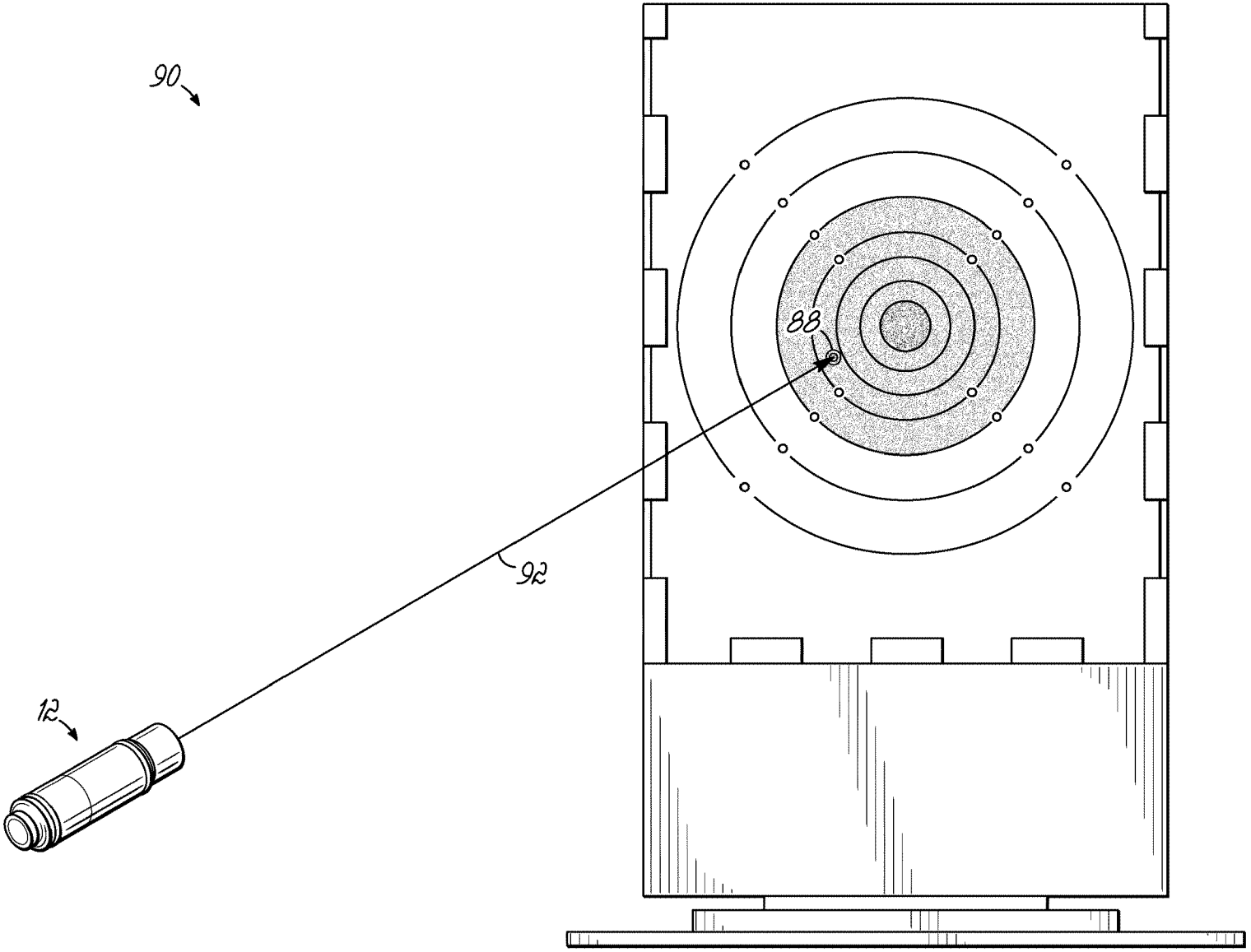
FIG. 8B is a diagram of a second configuration of the laser cartridge which causes a burst of light to illuminate a portion of the target for an extended time period.

FIGS. 8A and 8B are diagrams showing multiple configurations of the laser cartridge 12. For example, FIG. 8A is a diagram of a first configuration 84 of the laser cartridge 12 which causes a burst of light 86 to illuminate a portion of a target (shown as illumination point 88) for a short time period. When the laser cartridge 12 is placed into the firearm 14, and a user presses the trigger, the laser cartridge 12 will release a burst of light 86 that temporarily illuminates a portion of the target (e.g., illumination point 88).

FIG. 8B is a diagram of a second configuration 90 of the laser cartridge 12 which causes a burst of light 92 to illuminate a portion of the target (e.g., illumination point 88) for an extended time period. When the laser cartridge 12 is placed into the firearm, and a user presses the trigger, the laser cartridge 12 will release a burst of light 92 that continuously illuminates the illumination point 88 until a stop condition is satisfied. The stop condition may be satisfied when the user releases the trigger, after the expiration of a threshold amount of time, or based on another detectable or configurable condition being satisfied.

In some embodiments, the user may toggle between configurations prior to placing the laser cartridge 12 into the firearm 14. For example, the first configuration 84 may be set as a default selected configuration. To switch to the second configuration 90, the laser cartridge 12 may be configured such that the user can hold down the backer 50 for a threshold amount of time to cause the selected configuration to change to the second configuration 90. Additionally, or alternatively, the user may toggle between configurations after placing the laser cartridge 12 into the firearm 14. For example, the firearm 14 may have a switch that permits the user to toggle between the first and second configuration 84, 90. It is to be understood that these are provided by way of example. In practice, another type of trigger mechanism may be used to switch between configurations. Furthermore, the laser cartridge 12 may be configured to have any number of different configurations. For example, the laser cartridge 12 may have configurations corresponding to different ranges of time, such that each configuration corresponds to a specific duration in which light emanates from the laser cartridge 12. To provide another example, the laser cartridge 12 may have configurations corresponding to different spectral shades or colors of light, different frequencies of light, and/or the like.

FIGS. 9A-9L are diagrams of one or more example embodiments 100 for using a firearm training system. The firearm training system may include the computing device 4, the laser cartridge 12, a tripod 102 for supporting the computing device 4, and/or a target 104. As will be shown, the laser cartridge 12 may be used within the firearm 14 to permit a user to perform one or more training exercises with the firearm 14.

Figure 9A:
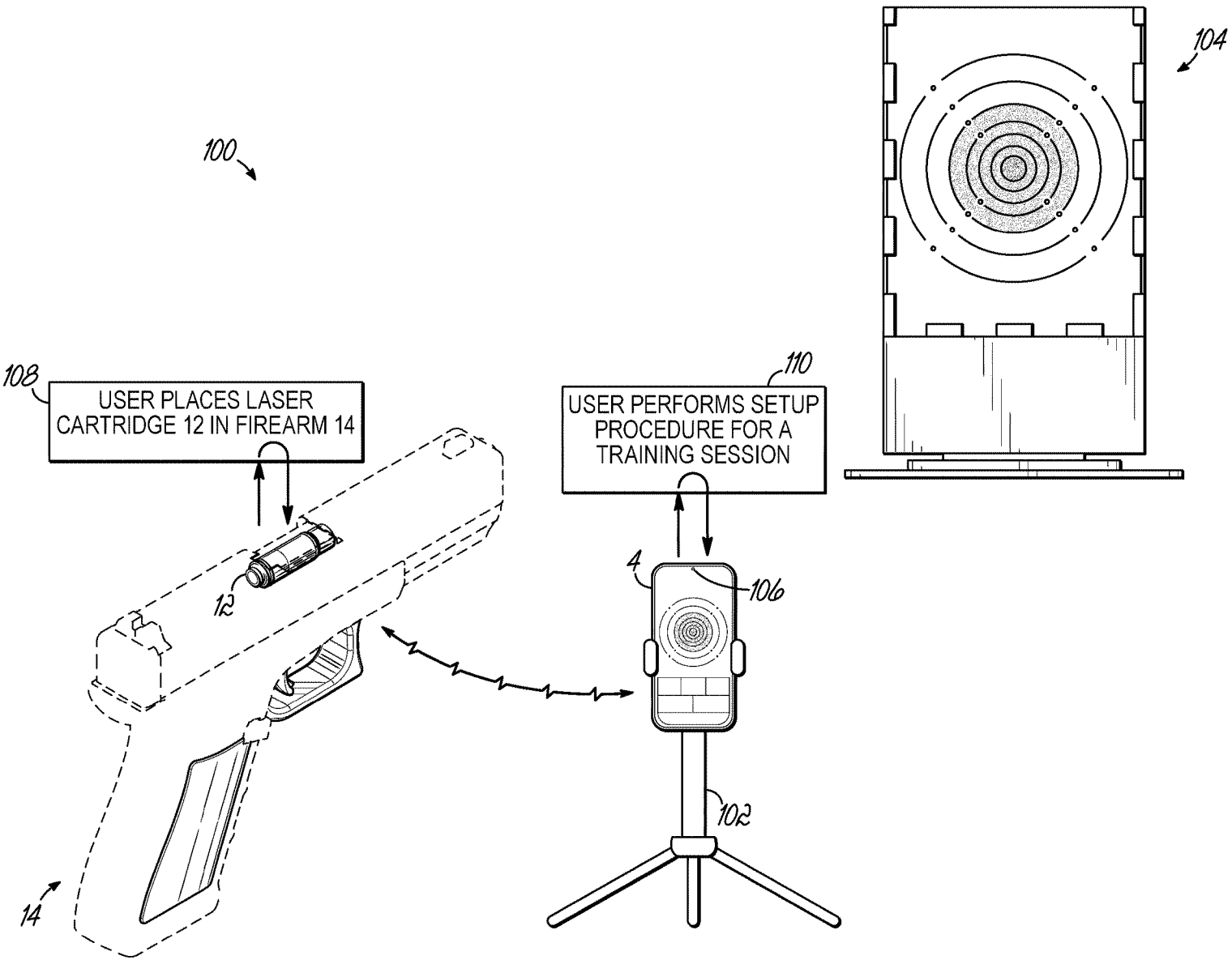
FIGS. 9A-9L are diagrams of one or more example embodiments described according to the principles of the present disclosure.

As shown in FIG. 9A, the computing device 4 may include a camera 106 for capturing a video of the target 104. In the embodiment shown, the computing device 4 is a mobile device, such as a cell phone. In practice, the computing device 4 may be another type of computing device, such as a desktop computer, a laptop computer, a tablet, and/or the like. The tripod 102 may be used to secure the computing device 4 in place such that the camera 106 maintains a clear view of the target 104. As shown, the target 104 provides one large target for the user to aim at. In some embodiments, the structure or design of the target 104 may be such that the user has a collection of targets 104 to at aim, where respective targets 104 have different shapes, sizes, and/or designs.

The laser cartridge 12 may be configured to release a light that illuminates a portion of the target 104. In some embodiments, the laser cartridge 12 may have multiple configurations that affect a duration in which the light illuminates the target 104. Example configurations are described in connection with FIGS. 8A and 8B.

As shown by reference number 108, the user may place the laser cartridge 12 into the firearm 14. For example, the user may place the laser cartridge 12 into the chamber 70 of the firearm 14 such that the firearm 14 can be used during a training session.

As shown by reference number 110, the user may perform a setup procedure for the training session. For example, the computing device 4 may support a firearm training application that displays a set of training session settings on a user interface. The setup procedure may instruct the user to calibrate the focus of the camera 106 on the target 104. The user may then select from a number of different training session settings. For example, the user may create a reusable template for a particular training session, where the user selects the type of firearm being used, the training exercise being performed, a desired game mode, a training session duration, types of targets being used, and/or the like. The user may also select one or more preferences for the training session, such as the type of training data or metrics that the user would like to have captured and/or determined during the training session, one or more training rules or limitations that impact the difficulty of the training session, and/or the like. Once the user has completed the setup procedure, the user may interact with (e.g., click on, select, etc.) the start button to begin the training session.

Figure 9B:
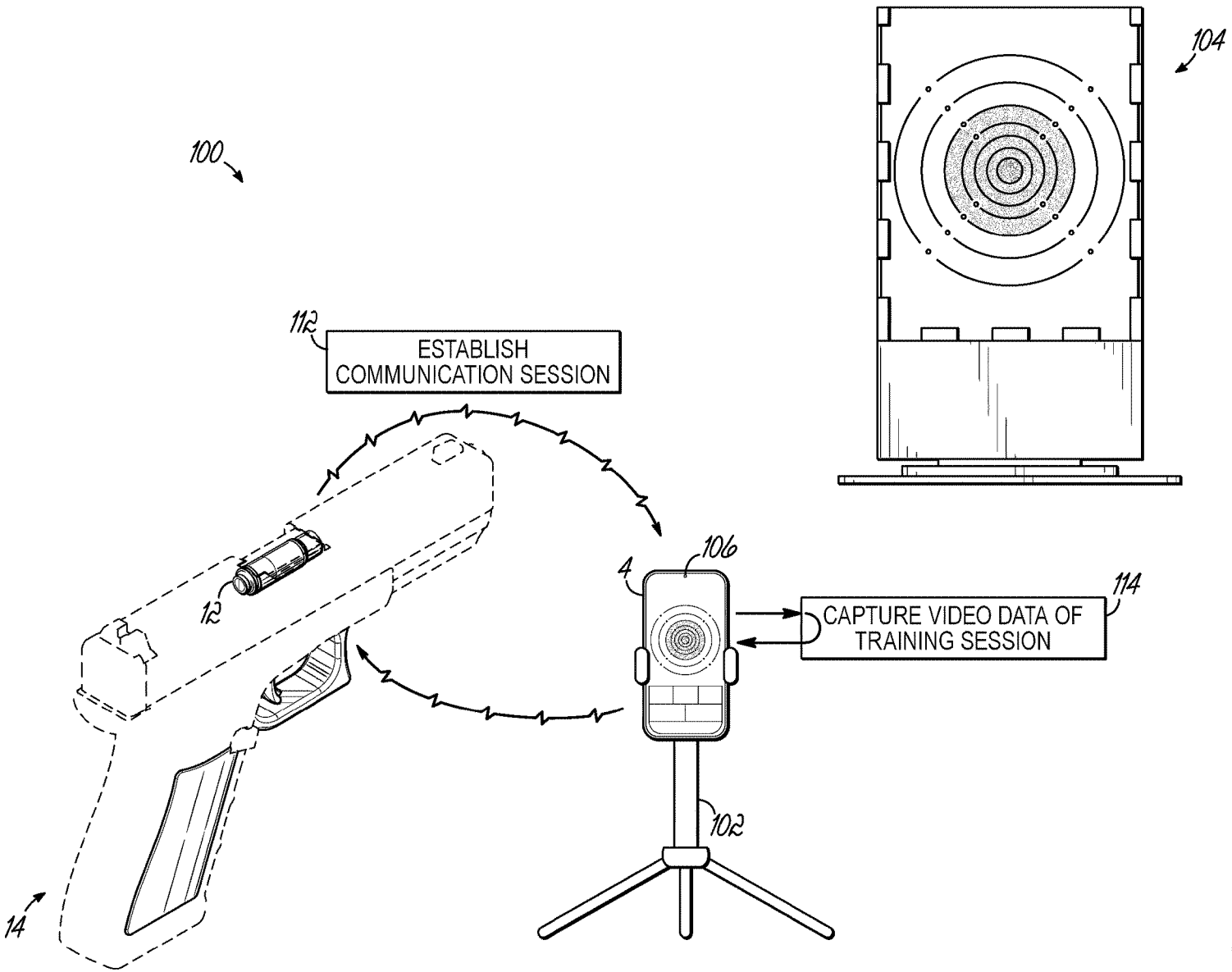

As shown in FIG. 9B, and by reference number 112, the computing device 4 may establish a communication session with the laser cartridge 12. The communication session may be a Bluetooth communication session, such as a Bluetooth low energy (BLE) communication session or another type of near-field (NF) communication session.

Establishing the communication session may be triggered based on the user initiating the setup procedure, completing the setup procedure, manually turning on a Bluetooth connection on the computing device 4, and/or any other trigger known in the art. To establish the communication session, the computing device 4 and the laser cartridge 12 may perform a device pairing process which includes a device discovery step, pairing request and response steps, a verification step, and a connection setup step. To provide a specific example, the computing device 4 may perform the device discovery step based on the user toggling on a Bluetooth connection. To identify the laser cartridge 12, the computing device 4 may perform a Bluetooth scan (e.g., a BLE scan) as part of a device discovery process. To pair with the laser cartridge 12, the computing device 4 may provide the laser cartridge 12 with a request to establish a Bluetooth communication session. The laser cartridge 12 may, based on receiving the request, provide the computing device 4 with a response specifying one or more Bluetooth capabilities and/or a unique key used to establish a secure connection. The computing device 4 may then verify the unique key to establish the Bluetooth communication session.

As shown by reference number 114, the computing device 4 may capture video data of the training session. For example, the computing device 4 may use the camera 106 to capture video data of the target 104 throughout the duration of the training session. As will be shown, the video data may be used to determine the user's performance during the training session.

Figure 9C:
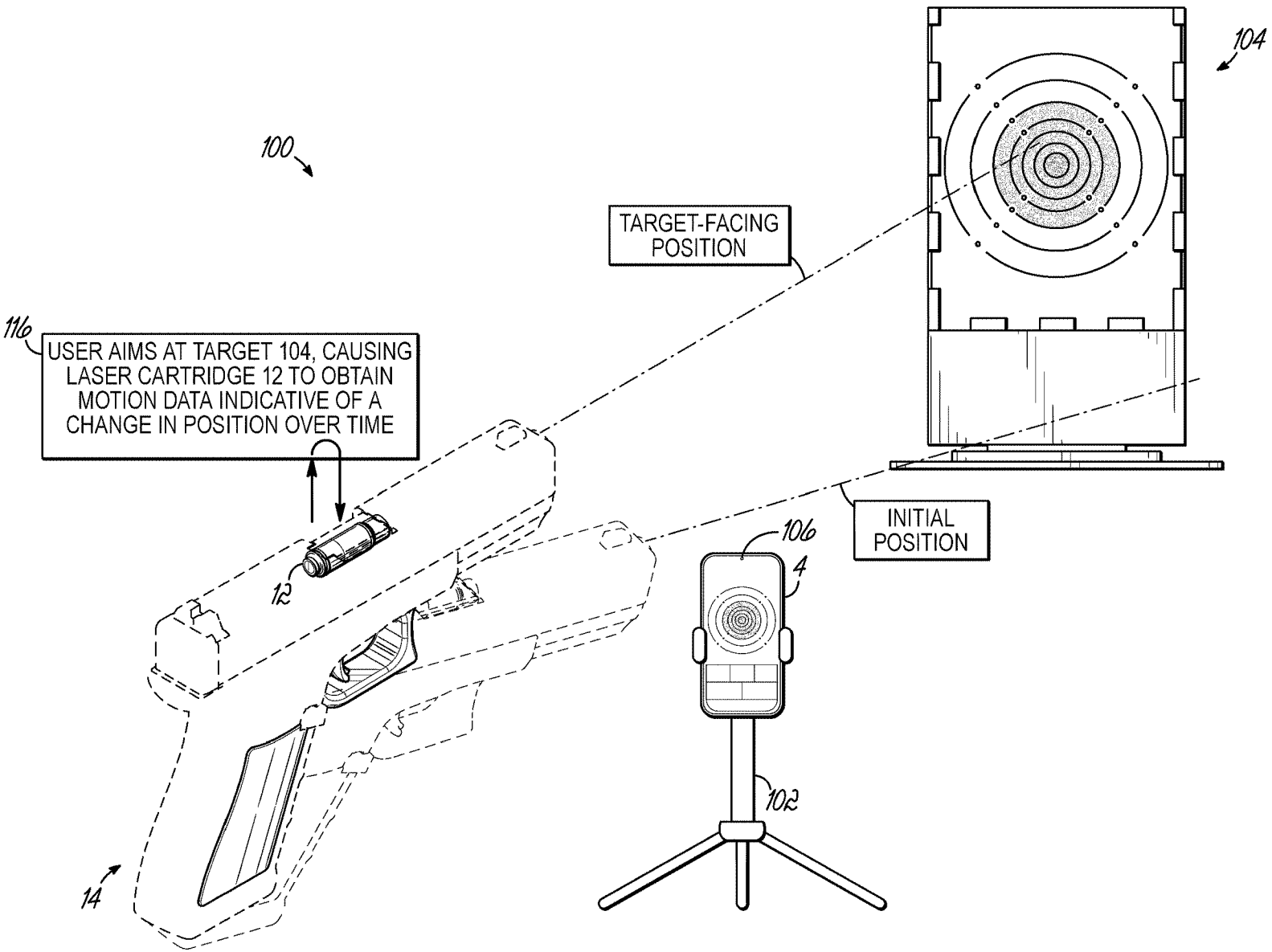

As shown in FIG. 9C, and by reference number 116, the user may aim at the target 104, causing the laser cartridge 12 to obtain motion data indicative of a change in position over time. In the example shown, the user points the firearm 14 toward the target 104, such as by moving the firearm 14 from an initial position to a target-facing position. During this time, a motion sensor of the laser cartridge 12 may measure acceleration of the firearm 14. For example, a motion sensor may measure acceleration of the firearm 14 by detecting a change in position or velocity over time. Signals indicative of the acceleration may be provided to a processor of the laser cartridge 12.

In some embodiments, the laser cartridge 12 may identify a reference position of the firearm 14. This allows the laser cartridge 12 to track movement of the firearm 14 relative to the reference position. The laser cartridge 12 may identify the reference position based on a trigger condition being satisfied. For example, the laser cartridge 12 may identify the reference position based on the user placing the laser cartridge 12 into the firearm 14, based on receiving an instruction from the computing device 4 (e.g., via the firearm training application), and/or based on another type of trigger condition being satisfied. To identify the reference position, the laser cartridge 12 may determine a current geographic location of the firearm 14. This determination can be made using the motion sensor, a global positioning system (GPS), and/or another type of sensor. The reference position may be defined in a two- or three-dimensional coordinate space (e.g., using an x-coordinate, a y-coordinate, and/or a z-coordinate).

In some embodiments, the laser cartridge 12 may determine one or more positions of the firearm 14 while the firearm 14 is in motion. For example, the laser cartridge 12 may determine one or more positions of the firearm 14 based on the acceleration of the firearm 14 relative to the identified reference position. To determine positions of the firearm 14 at various time periods, the processor of the laser cartridge 12 may process the motion data and reference position data using one or more numerical integration techniques, one or more extrapolation techniques, and/or the like. The one or more positions may collectively represent a targeting path, which is a path in which the firearm 14 moves between an initial position and a target-facing position.

In some embodiments, the one or more positions of the firearm 14 may be determined by the computing device 4 (e.g., instead of by the laser cartridge 12). For example, the laser cartridge 12 may provide reference position data and motion data to the computing device 4. This allows the computing device 4 to process this data (e.g., using one or more techniques described above) to determine the one or more positions of the firearm 14. This embodiment is described in additional detail in FIG. 9I.

Figure 9D:
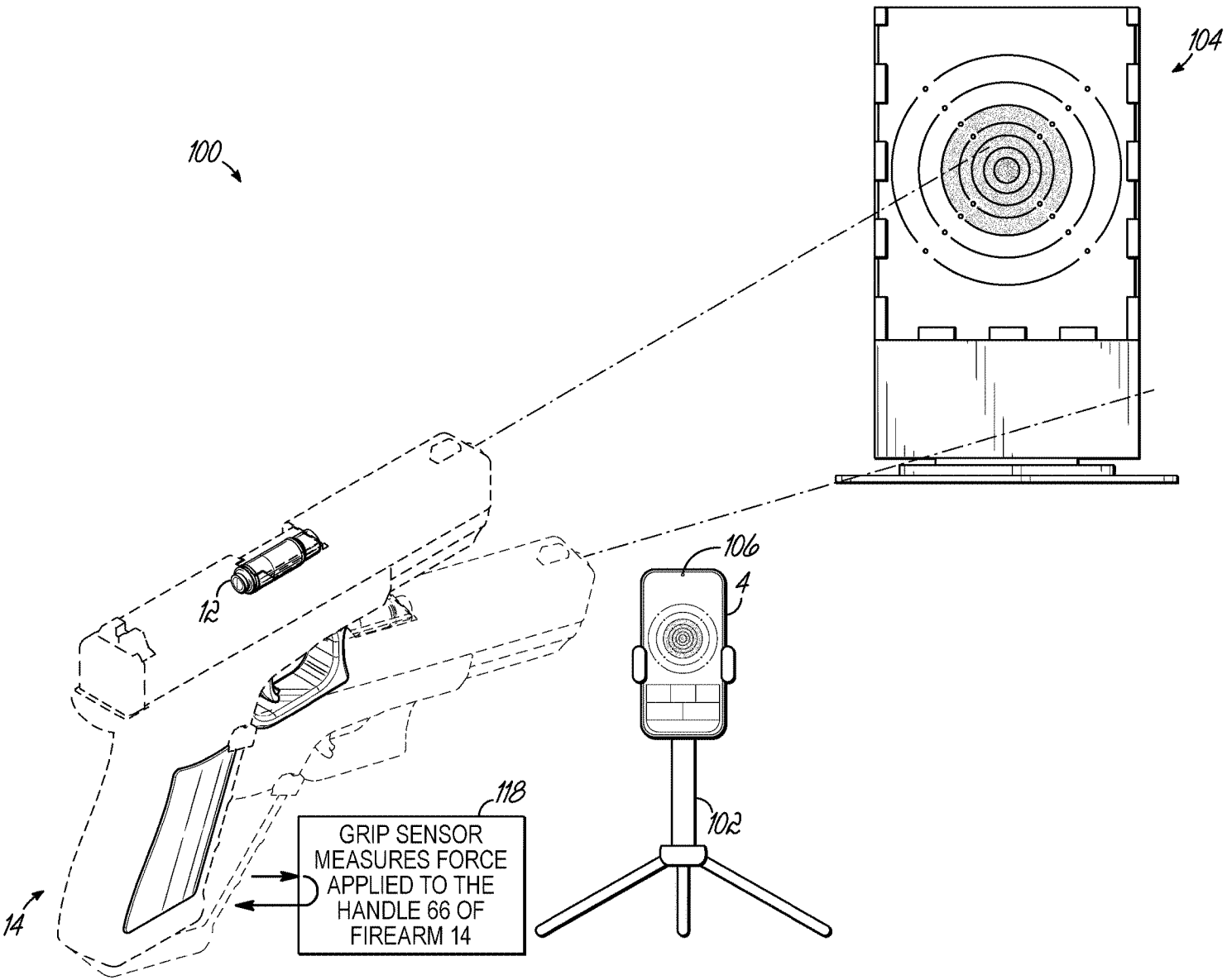

As shown in FIG. 9D, and by reference number 118, a grip sensor may measure the force applied to the handle 66 of the firearm 14. For example, while the user is moving the firearm 14 from the initial position to the target-facing position, a grip sensor located on the handle 66 of the firearm 14 may measure a force applied to one or more locations of the handle 66. As will be explained further herein, by measuring the force applied to one or more locations of the handle 66, the computing device 4 will be able to process this data to determine whether the user's hands are positioned in the appropriate places on the handle 66, determine whether the user's grip of the handle 66 is firm enough to comply with a standard (e.g., a safety standard, a performance standard, etc.), and/or the like.

Figure 9E:
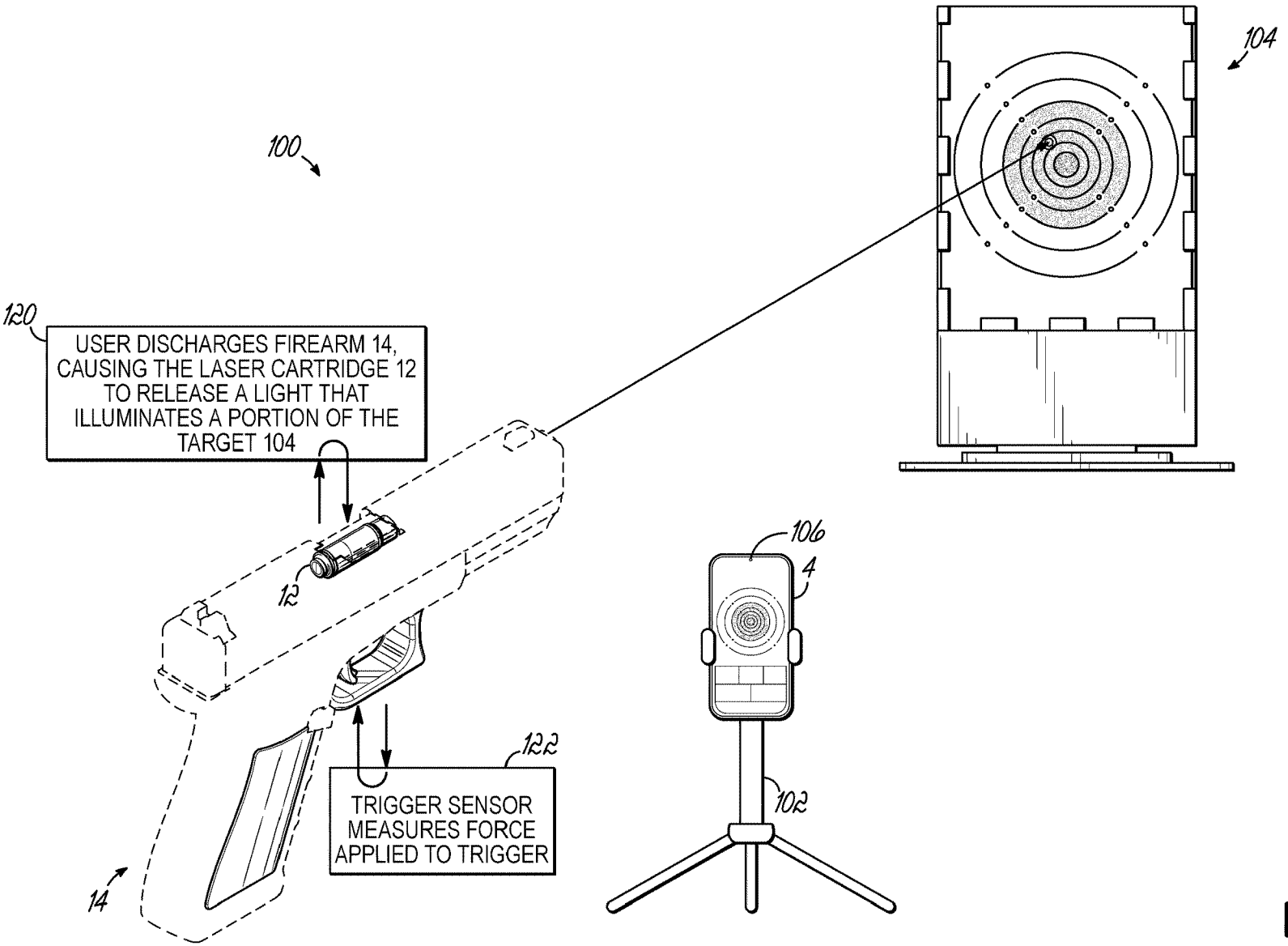

As shown in FIG. 9E, and by reference number 120, the user may discharge the firearm 14, causing the laser cartridge 12 to release a light that illuminates a portion of the target 104. For example, the user may press on the trigger 72 of the firearm 14. This causes a firing pin of the firearm 14 to project toward the backer 50 of the laser cartridge 12. When the firing pin contacts the backer 50, the laser cartridge 12 releases light that illuminates a portion of the target 104.

As shown by reference number 122, a trigger sensor may measure a force applied to the trigger 72. For example, a trigger sensor may measure a force applied to the trigger 72 by measuring changes in resistance when the trigger 72 is subjected to deformation or stress. The trigger sensor can be positioned within the trigger 72 and can deform slightly when the trigger 72 is pressed, allowing for changes in resistance to be measured. The trigger sensor may include a strain gauge, a piezoelectric sensor, and/or another type of sensing mechanism.

Additionally, or alternatively, the trigger sensor may measure the speed at which the trigger 72 is pulled. For example, if a piezoelectric sensor is used, an electrical charge can be generated in response to changes in pressure. When the trigger 72 is pulled, pressure changes and the piezoelectric sensor can generate a voltage signal that can be measured and analyzed to determine trigger speed.

The trigger sensor may provide, to the laser cartridge 12, signals representative of the measured force applied to the trigger 72 and/or signals representative of the speed at which the trigger 72 is pulled. As will be explained further herein, this allows the computing device 4 to analyze the force applied to the trigger 72 and/or the trigger speed, and further allows the computing device 4 to determine if the user is pulling the trigger in a safe and/or efficient manner.

Figure 9F:
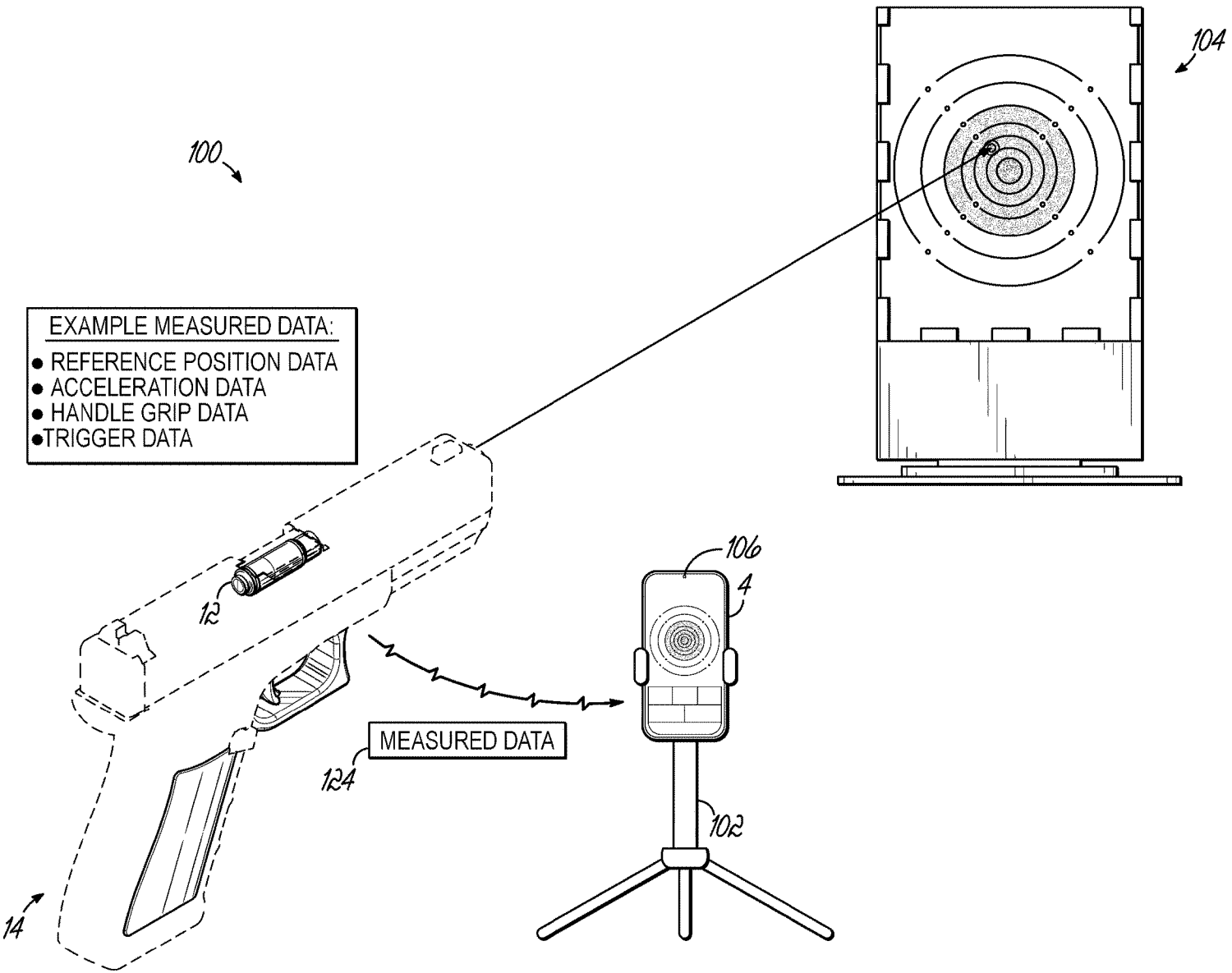

As shown in FIG. 9F, and by reference number 124, the laser cartridge 12 may provide one or more types of measured sensor data to the computing device 4. For example, the laser cartridge 12 may, via the communication session, provide the computing device 4 with measured sensor data such as reference position data, motion data (e.g., acceleration data, etc.), handle grip data, trigger data, and/or the like.

In some embodiments, the laser cartridge 12 may be configured to provide measured sensor data to the computing device 4 periodically based on a condition being satisfied. The condition may be the expiration of a configured time period, after a shot has been fired, at the conclusion of the training session, and/or based on any other type of condition.

In some embodiments, the measured sensor data may include handle grip data. In this case, the grip sensor may provide, to the laser cartridge 12, signals representative of the force applied to the one or more locations on the handle 66. This allows the laser cartridge 12 to use the communication session to transmit, to the computing device 4, handle grip data identifying the measured force. In some embodiments, the grip sensor may be part of a separate circuit board and a processor of the circuit board may provide the handle grip data directly to the computing device 4.

In some embodiments, the measured sensor data may include trigger data. In this case, the trigger sensor may provide signals representative of the force applied to the trigger 72 to the laser cartridge 12. This allows the laser cartridge 12 to use the communication session to transmit, to the computing device 4, trigger data identifying the force applied to the trigger 72. In some embodiments, the trigger sensor may be part of a separate circuit board and a processor of the circuit board may provide the trigger data directly to the computing device 4.

Figure 9G:
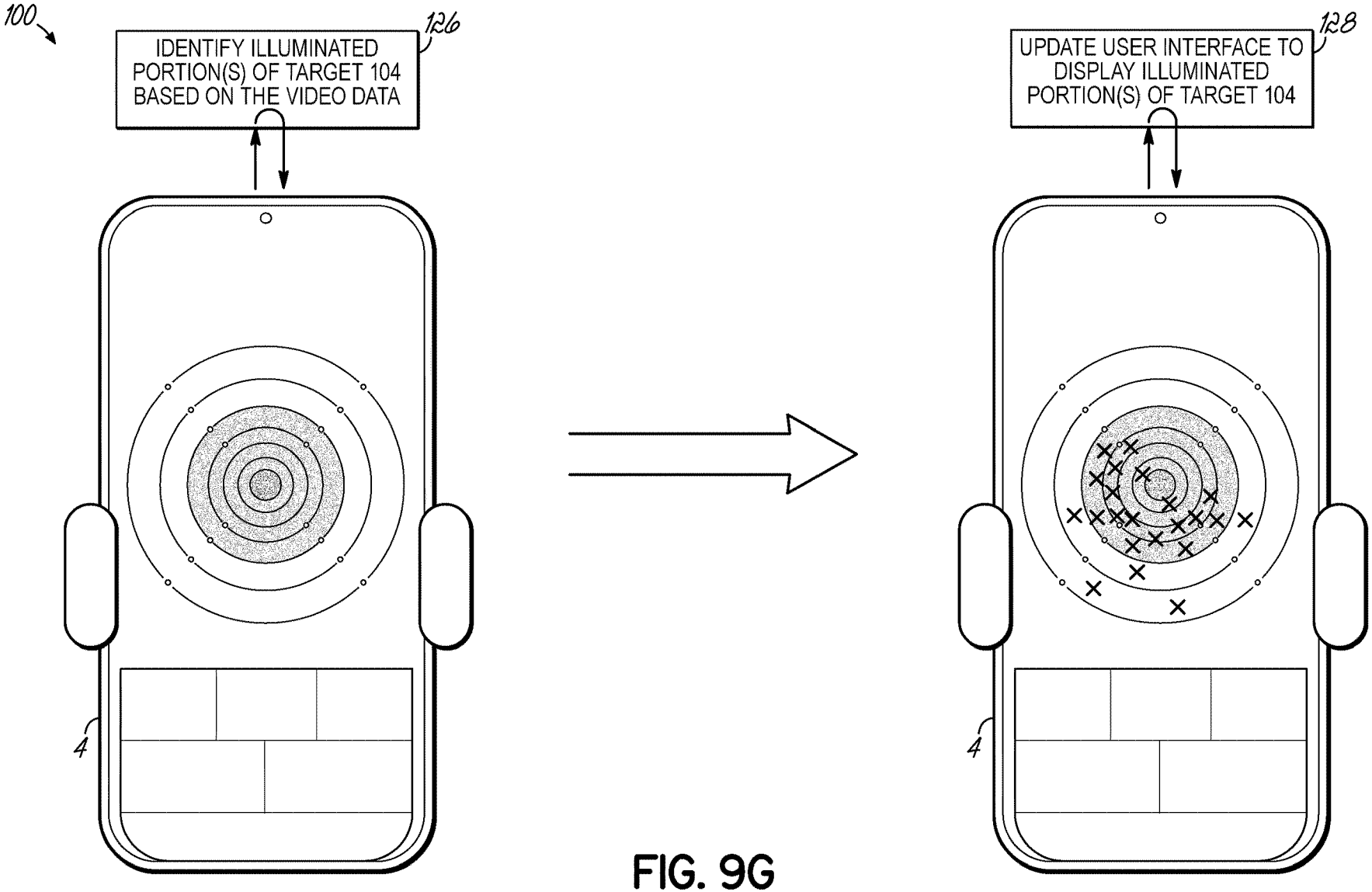

As shown in FIG. 9G, and by reference number 126, the computing device 4 may identify the illuminated portion(s) of the target 104. For example, the computing device 4 may process the video data using one or more computer vision techniques, one or more natural language processing techniques, and/or the like, to identify the illuminated portion(s) of the target 104. To provide a specific example, the computing device 4 may execute a computer vision technique to identify boundaries of the target 104 and to identify an illuminated portion within those boundaries. To identify the illuminated portion of the target 104, the computing device 4 may execute a color filtering technique capable of identifying that a portion of the target 104 has been illuminated by a red light.

As shown by reference number 128, the computing device 4 may update a user interface to display the illuminated portion(s) of the target 104. For example, the computing device 4 may provide, for display on a user interface of the firearm training application, a graphical representation of the target 104 that depicts one or more locations in which the light emanating from the laser cartridge 12 struck the target 102. In some embodiments, the user interface may display a recording of the training session such that the user can see when particular portions of the target 104 were struck by the light emanating from the laser cartridge 12.

Figure 9H:
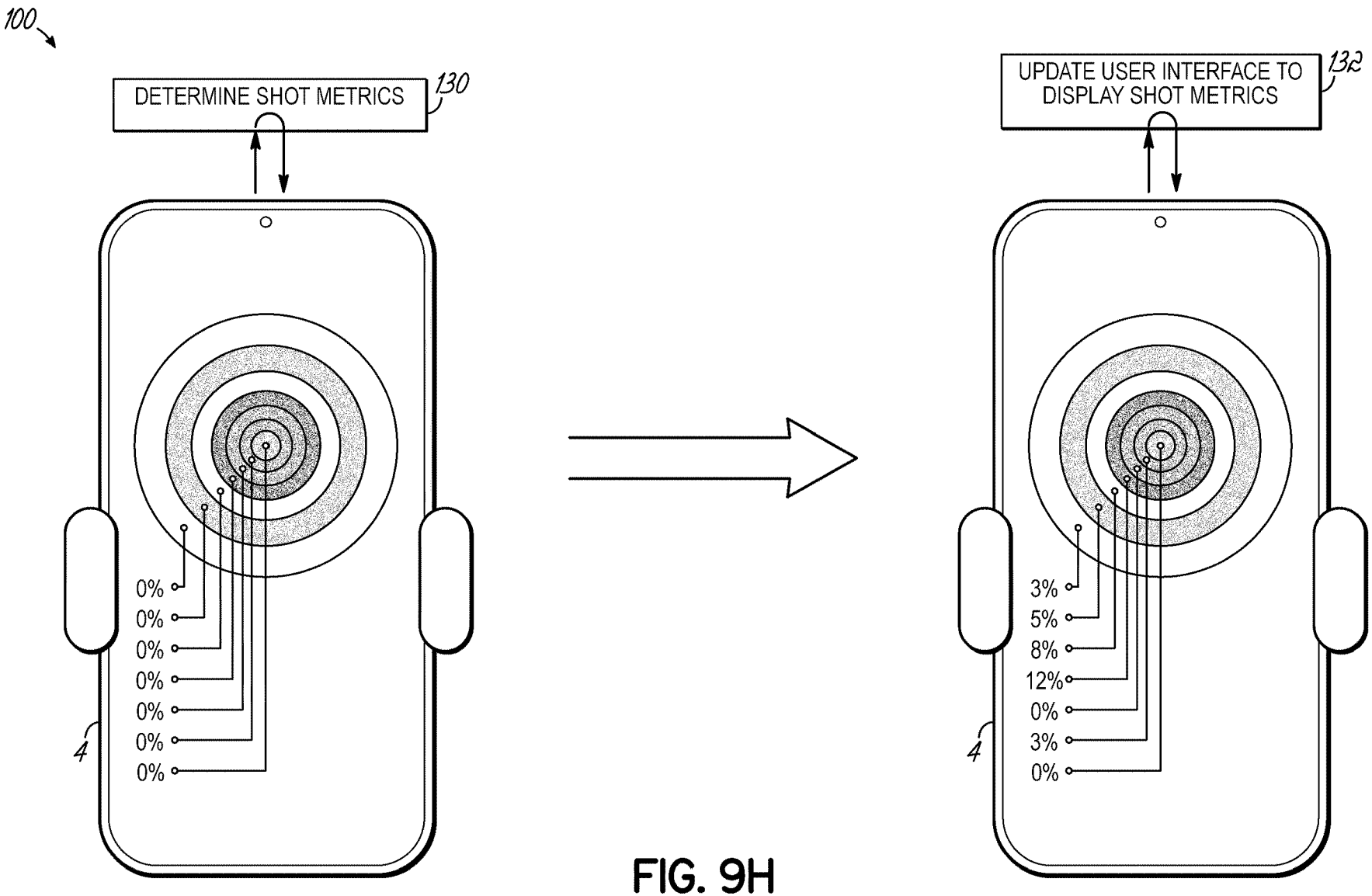

As shown in FIG. 9H, and by reference number 130, the computing device 4 may determine shot metrics for the training session. For example, the computing device 4 may process data identifying the target 104 and data identifying the illuminated portion(s) of the target 104 to determine one or more shot metrics representing the accuracy of the user. The shot metrics may include a metric indicating a number or percentage of shots that contacted each respective region of the target 104, a metric indicating a duration in which it took the user to hit a certain area within the target 104 (e.g., the bullseye, etc.), and/or the like. FIG. 9H shows example shot metrics for various regions of the target 104.

As shown by reference number 132, the computing device 4 may update the user interface to display the shot metrics. In the example shown, the user interface may display, out of a total number of shots taken by the user, the percentage of shots that contacted each respective region within the target 104.

Figure 9I:
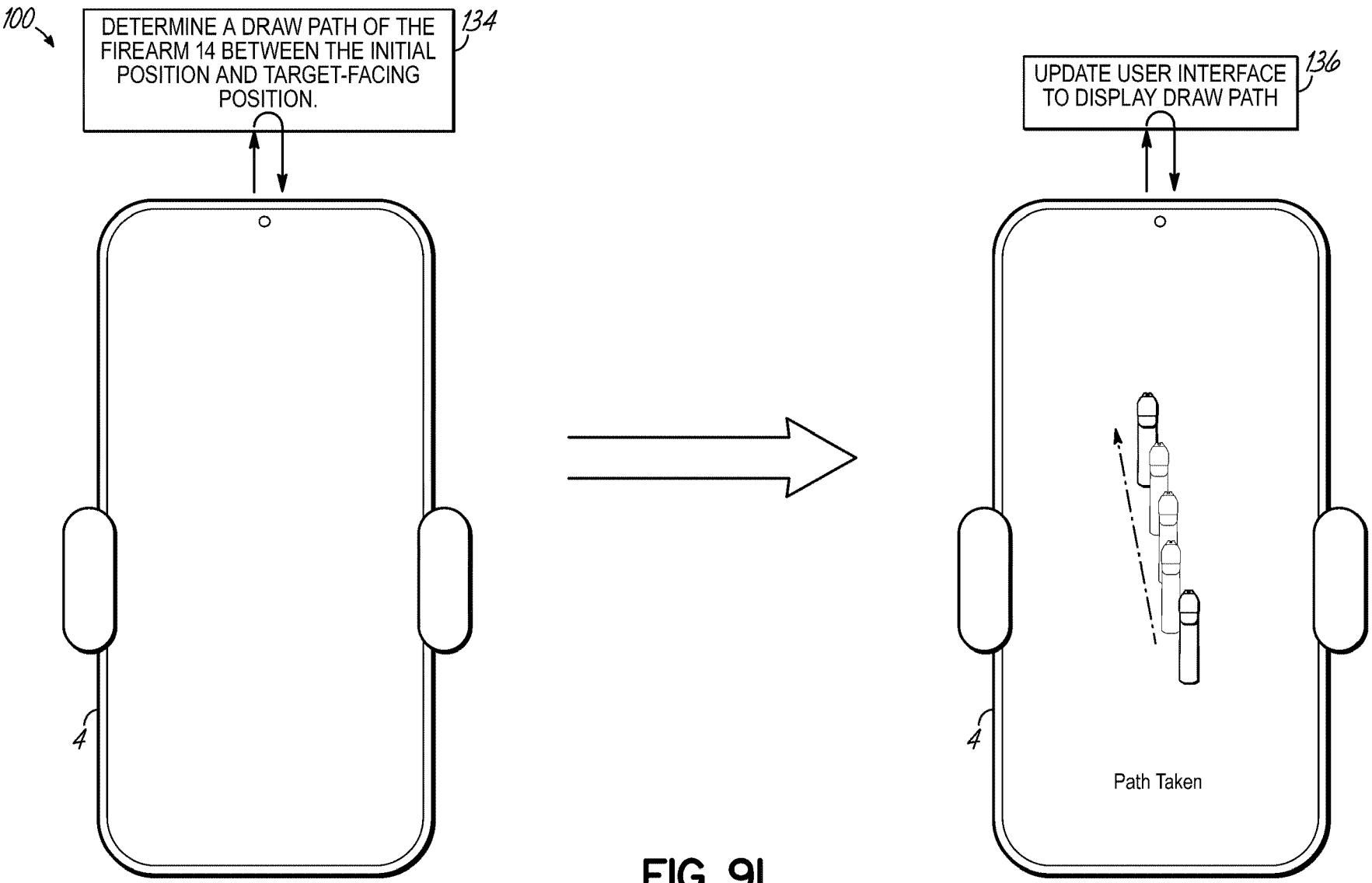

As shown in FIG. 9I, and by reference number 134, the computing device 4 may determine a targeting path of the firearm 14. For example, the computing device 4 may process the reference position data and the motion data to determine a targeting path between the initial position and the target-facing position. The targeting path may be defined using a 2- or 3-D coordinate space and represents the draw motion made by the user when moving the firearm 14 from the initial position to the target-facing position. For example, to determine the targeting path, the computing device 4 may identify coordinates for a set of positions on the targeting path, where the initial position has an x-, y-, and/or z-coordinate, and where one or more other positions on the targeting path have x-, y-, and/or z-coordinates. The computing device 4 may analyze the reference position data and the motion data (e.g., the acceleration data) to determine the one or more other positions along the targeting path. In some embodiments, the laser cartridge 12 (rather than the computing device 4) may determine the one or more positions along the targeting path and may provide path data identifying the targeting path to the computing device 4. This embodiment is also described in connection with FIG. 9C.

As shown by reference number 136, the computing device 4 may update the user interface to display the targeting path. For example, the computing device 4 may provide a graphical representation of the targeting path for display on the user interface, such that the user is able to view the draw motion made by the user (e.g., the motion of the firearm 14 between the initial position to the target-facing position). In FIG. 9I, a graphical representation of the targeting path is shown. The graphical representation of the lower-most laser cartridge 12 represents the laser cartridge 12 in the initial position and the graphical representation of the upper-most laser cartridge 12 represents the laser cartridge 12 in the target-facing position.

Figure 9J:
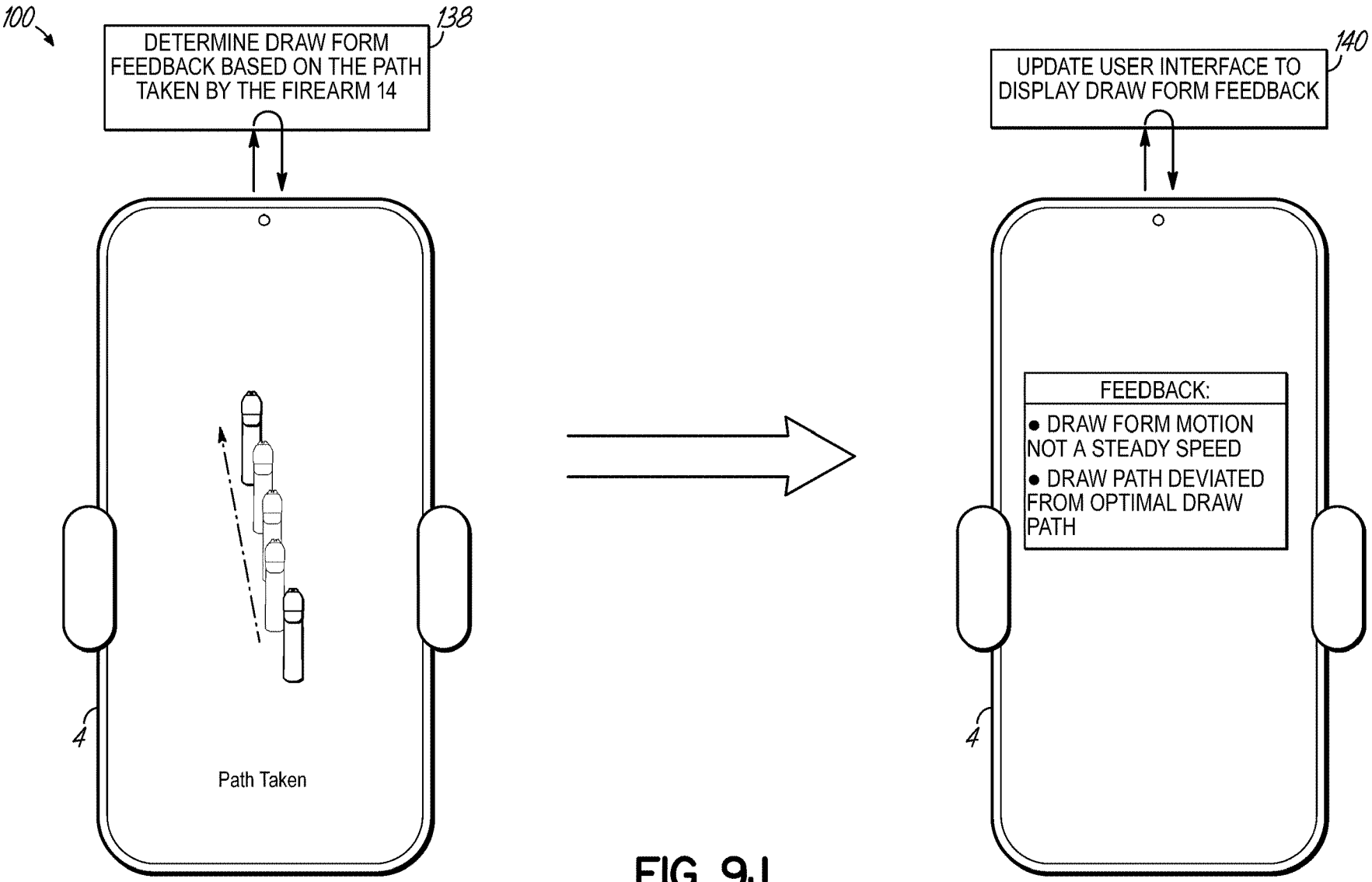

As shown in FIG. 9J, and by reference number 138, the computing device 4 may determine draw form feedback based on the targeting path taken by the firearm 14. For example, the computing device 4 may compare targeting path data identifying the targeting path with stored targeting path data identifying one or more configured targeting paths, may identify one or more differences between characteristics of the targeting path and corresponding characteristics of the one or more configured targeting paths, and may determine the draw form feedback based on the one or more identified differences. Each of these steps is described below.

The computing device 4 may compare the targeting path data identifying the targeting path of the firearm 14 with the stored targeting path data identifying the one or more configured targeting paths. The one or more configured targeting paths may be defined by one or more standards, such as a firearm safety standard, an efficiency standard, and/or another standard known in the art. A standard may be based on a law, a regulation, an opinion of an expert in the field of firearms usage, and/or another source known in the art. To provide a specific example, a safety standard may define what is viewed as the optimal targeting path from a firearm safety perspective. In this example, the stored targeting path data that identifies a configured targeting path may represent the optimal targeting path from a firearm safety perspective.

In some embodiments, the stored targeting path data may include time data corresponding to positions of the firearm 14 along the targeting path. For example, the stored targeting path data may include values representing positions of a firearm along the targeting path and these values may be stored in association with time values identifying respective times. By tracking time data, the configured targeting path not only represents an optimal motion to make (e.g., from a safety perspective, an efficiency perspective, etc.), but also the optimal draw speed (e.g., an optimal draw motion from a safety perspective, efficiency perspective, etc. may have an optimal or suggested draw speed).

In some embodiments, the stored targeting path data may include data identifying multiple targeting paths to account for different usage scenarios. For example, what is characterized as the safest targeting path, the most efficient targeting path, etc., may change depending on the context in which the firearm 14 is being used. For this reason, the stored targeting path data may include data identifying multiple targeting paths that account for each respective usage scenario.

In some embodiments, the stored targeting path data may include values that identify targeting paths corresponding to different performance levels. To provide a specific example, the stored targeting path data may include values identifying three targeting paths, where each respective targeting path corresponds to different measurable safety standard, efficiency standard, and/or the like.

The computing device 4 may identify one or more differences between the targeting path and configured targeting paths. For example, the computing device 4 may process the targeting path data to identify one or more characteristics of the targeting path, may reference the data structure to identify one or more corresponding characteristics of each respective configured targeting path, and may compare respective characteristics of the targeting path with corresponding characteristics of each configured targeting path to identify the one or more differences. Characteristics of a targeting path and/or a configured targeting path may include a characteristic indicating a position of the firearm 14 at a given time, a characteristic indicating a direction of motion of the firearm 14 at a given time, a characteristic indicating a speed and/or acceleration of the firearm 14 at a given time, a characteristic indicating a time taken to move the firearm 14 between two or more positions, and/or the like. By comparing characteristics of the targeting path with corresponding characteristics of the one or more stored targeting paths, the computing device 4 is able to identify differences between the targeting path and corresponding configured targeting path(s). These differences represent a degree to which the draw form of the user deviates from a configured draw form defined by a standard (e.g., a safety standard, efficiency standard, etc.).

The computing device 4 may determine draw form feedback based on the one or more differences. For example, a data structure may associate draw form feedback values with values identifying degrees to which (or ranges in which) characteristics of a targeting path differ from corresponding characteristics of the one or more configured targeting paths. To provide a specific example, assume a configured targeting path identifies a path representing the safest path that the user could take when drawing the firearm 14. Further assume a first targeting path of the user deviates from this path by one millimeter, and that a second targeting path of the user deviates from this path by one foot. Further assume the data structure associates a first set of one or more draw form feedback values with stored targeting path values corresponding to the first targeting path and associates a second set of one or more draw form feedback values with stored targeting path values corresponding to the second targeting path. The computing device 4 may reference or search the data structure using the targeting path values for the first and second targeting path. This allows the computing device 4 to identify corresponding (or related) stored targeting path values, which may be stored in association with the appropriate draw form feedback values.

It is to be understood that the steps described above are provided by way of example, and that in practice, the draw form feedback may be determined using additional steps, fewer steps, different steps, and/or different embodiments of the same step. For example, rather than reference a data structure, the computing device 4 may determine draw form feedback by executing a rules engine to analyze the targeting path data, the stored targeting path data corresponding to the configured targeting paths, and/or the values identifying the differences between the targeting path and corresponding configured targeting paths.

As shown by reference number 140, the computing device 4 may update the user interface to display the draw form feedback. In the example shown, the draw form feedback includes feedback indicating that the user did not draw the firearm 14 at a steady, consistent speed, and feedback indicating that the targeting path deviated from an optimal or configured targeting path. Additionally, or alternatively, the draw form feedback may include feedback indicating a degree to which the targeting path deviated from the configured targeting path, feedback indicating the part of the draw form path in which the user deviated from the path, feedback indicating another type of recommendation relating to user's form when handling the firearm 14, and/or the like. In some embodiments, while not shown, the user interface may provide a side-by-side comparison of a 3-D representation of the targeting path taken by the firearm 14 and a 3-D representation of the optimal targeting path.

Figure 9K:
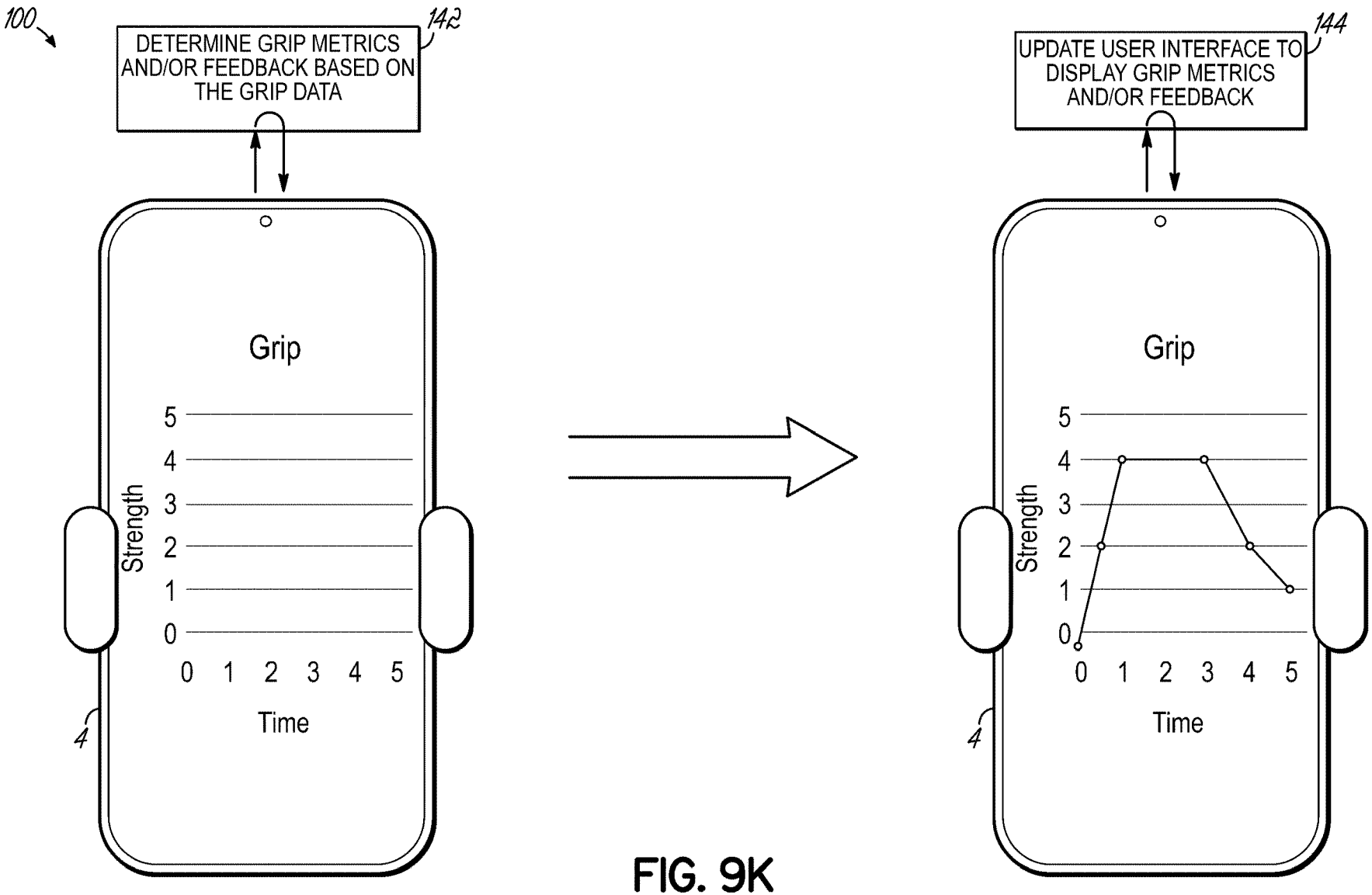

As shown in FIG. 9K, and by reference number 142, the computing device 4 may determine grip metrics and/or feedback based on the handle grip data. For example, the computing device 4 may process the handle grip data to determine grip metrics, such as a metric indicating a variability of applied force, a metric indicating a distribution of force, a metric indicating a level of grip stability, a metric indicating a level of fatigue, and/or the like. The metric indicating the variability of applied force may be determined based on fluctuations in force over time, which may be used to determine how consistent of a grip the user has on the firearm 14. The metric indicating the distribution of force may be determined based on an analysis of force applied to different parts of the handle 66, which may be used to determine whether the user is gripping the handle evenly. The metric indicating the level of grip stability may be determined based on the rate of change of force over time and may represent how stable of a grip the user has on the handle 66. The metric indicating the level of fatigue may be determined based on the force applied to the handle 66 over time and may be indicative of the user experiencing fatigue throughout the training session.

In some embodiments, the computing device 4 may process the handle grip data to identify which fingers of the user are applying particular forces. By identifying which fingers of the user are applying particular forces, the computing device 4 can determine grip metrics corresponding to each respective finger, and can determine more-specific grip feedback, as will be described further herein.

In some embodiments, the computing device 4 may determine grip feedback. The grip feedback may include feedback indicating that the user is applying too much or too little force when gripping the handle 66, feedback indicating one or more recommended ways in which to adjust the user's grip on the handle 66, feedback indicating how the user improved or regressed relative to a past performance, feedback indicating diagnostic information, such as how evenly the user grips the handle 66 or how stable of a grip the user has on the handle 66, and/or the like.

In some embodiments, the computing device 4 may determine the grip feedback by referencing a data structure that associates grip feedback values with handle grip values and/or grip metric values. The stored handle grip values may indicate one or more forces to apply to respective locations on a handle of a firearm and may collectively represent a configured handle grip (e.g., an optimal handle grip, a recommended handle grip, etc.). The configured handle grip may be defined by a standard, such as a safety standard, an efficiency standard, etc. The computing device 4 may use the determined handle grip values to reference the data structure and identify corresponding stored handle grip values. The corresponding stored handle grip values may be stored in association with related grip metric values and/or grip feedback values.

In some embodiments, the computing device 4 may determine the grip feedback based on one or more differences between the handle grip data and the stored handle grip data. For example, the computing device 4 may compare the handle grip data and stored handle grip data to identify the one or more differences. In some situations, the computing device 4 may reference a data structure that stores values representing ranges of handle grip values and/or permissible deviations of values from respective stored handle grip values. These values may be stored in association with the grip feedback values. The computing device 4 may reference the data structure to determine which grip feedback values are stored in association with the values representing the one or more differences between the handle grip data and the stored handle grip data.

As shown by reference number 144, the computing device 4 may update the user interface to display the grip metrics and/or feedback. In the example shown, the computing device 4 updates the user interface to display grip metrics showing a graphical representation of the strength of the user's grip over time. Additionally, or alternatively, the computing device 4 may update the user interface to display a graphical representation of one or more types of grip feedback.

Figure 9L:
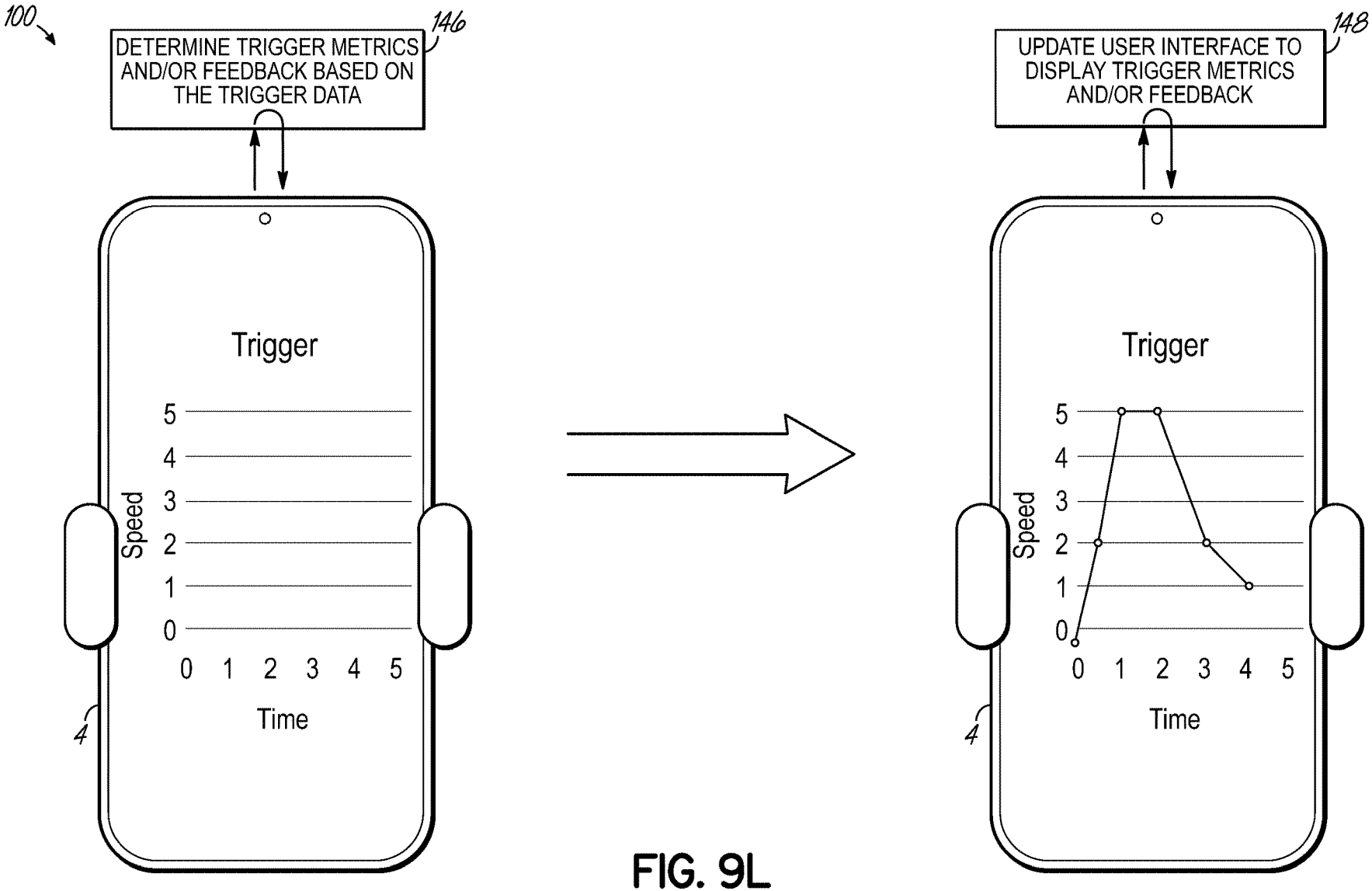

As shown in FIG. 9L, and by reference number 146, the computing device 4 may determine trigger metrics and/or feedback based on the trigger data. For example, the computing device 4 may process the trigger data to determine trigger metrics, such as a metric indicating a trigger pull weight, a metric indicating a trigger pull duration, a metric indicating a trigger finger placement, and/or the like. The metric indicating the trigger pull weight may be determined based on the total force required to pull the trigger 72. The metric indicating the trigger pull duration may be determined based on the total time needed for the user to press the trigger 72 and may be used to assist in the user in improving his or her trigger pull timing. The metric indicating the trigger finger placement may be determined based on the trigger data identifying the force applied to the trigger 72 and may be used to help the user adjust his or her finger placement to achieve an optimal trigger press. Additionally, or alternatively, the trigger metrics may include aggregated trigger data, such as a metric indicating a standard deviation of the pull force applied to the trigger 72, a metric indicating a rate at which force increases or decreases as the trigger 72 is pressed and released, and/or the like.

In some embodiments, the computing device 4 may determine trigger feedback. The trigger feedback may include feedback indicating that the user is applying too much or too little force to the trigger 72, feedback indicating that the user is pressing and/or releasing the trigger 72 at a sufficient or insufficient speed, feedback indicating one or more recommended ways in which to apply a different amount of force to the trigger 72 (e.g., such as by adjusting a finger placement on the trigger, etc.), feedback indicating how the user improved or regressed relative to a past performance, and/or the like.

In some embodiments, the computing device 4 may determine the trigger feedback by referencing a data structure that associates trigger feedback values with stored trigger values and/or trigger metric values. The stored trigger values may include values indicating one or more forces to apply to the trigger 72, values identifying a speed at which a trigger of a firearm is pulled, values identifying particular squeeze methods for pulling a trigger, and/or the like. A set of stored trigger values may collectively represent a configured trigger technique (e.g., an optimal way in which to press and/or release the trigger 72). The configured trigger technique may be defined by a standard, such as a safety standard, an efficiency standard, etc. The computing device 4 may use the determined trigger values to reference the data structure and identify corresponding stored trigger values. The corresponding stored trigger values may be stored in association with related trigger metric values and/or trigger feedback values.

In some embodiments, certain trigger feedback values may be stored in association with a range of stored trigger values. For example, assume the user discharges the firearm 14 by applying a first amount of force to the trigger 72. Further assume the user discharges the firearm 14 a second time by applying a second amount of force to the trigger 72 of the firearm 14, where the difference between the first and second applied forces is negligible. In this example, the appropriate trigger feedback for the user may be same, despite the application of two different forces to the trigger 72. As such, the data structure may associate certain trigger feedback values with multiple stored trigger values (i.e., ranges of stored trigger values).

In some embodiments, the computing device 4 may determine the trigger feedback based on one or more differences between the trigger data and the stored trigger data. For example, the computing device 4 may compare the trigger data and stored trigger data to identify the one or more differences. In some situations, the computing device 4 may reference a data structure that stores values representing ranges of trigger values and/or permissible deviations of values from respective stored trigger values. These values may be stored in association with the trigger values. The computing device 4 may reference the data structure to determine which trigger feedback values are stored in association with the values representing the one or more differences between the trigger values and the stored trigger values.

As shown by reference number 148, the computing device 4 may update the user interface to display trigger metrics and/or feedback. In the example shown, the computing device 4 updates the user interface to display trigger metrics showing a graphical representation of the speed of the user's trigger pull over time (e.g., for two separate trigger pulls). Additionally, or alternatively, the computing device 4 may update the user interface to display a graphical representation of one or more types of trigger feedback.

One or more types of data are described as being provided for display on the user interface. It is noted that in some embodiments, different types of data may be provided for display on the same user interface (e.g., on separate areas of the same display screen), and that in some embodiments, different types of data may be provided for display on separate user interfaces (e.g., on separate display screens).

As indicated above, FIGS. 9A-9L are provided merely as an example. Other examples may differ from what is described with reference to FIGS. 9A-9L. For example, there may be additional devices and/or networks, fewer devices and/or networks, different devices and/or networks, or differently arranged devices and/or networks than those shown in FIGS. 9A-9L. Furthermore, two or more devices shown in FIGS. 9A-9L may be implemented within a single device, or a single device shown in FIGS. 9A-9L may be implemented as multiple and/or distributed devices. Additionally, or alternatively, a set of devices (e.g., one or more devices) of example embodiment(s) 100 may perform one or more functions described as being performed by another set of devices of example embodiment(s) 100.

Figure 10:
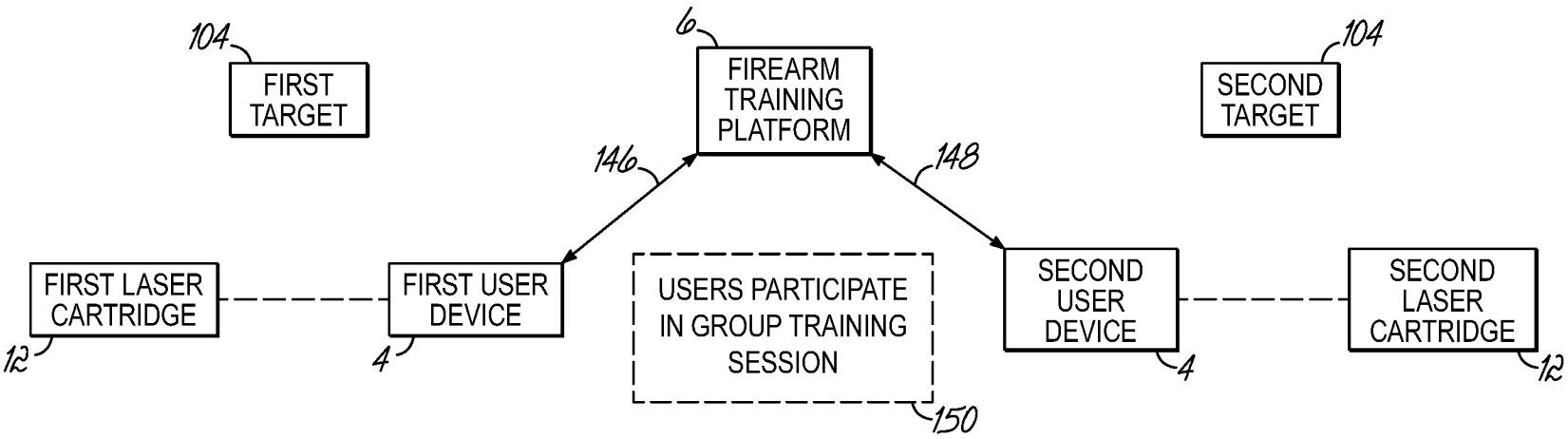
FIG. 10 is a diagram of a firearm training platform orchestrating a training session or competition between users in remote locations.

FIG. 10 is a diagram of a firearm training platform 6 orchestrating a training session or competition between users in remote locations. For example, and as shown by reference number 150, multiple users may participate in a group training session. In this case, the firearm training platform 6 may receive communications from multiple computing devices 4 and may provide each respective computing device 4 with access to performance data for all users participating in the group training session.

In some embodiments, the firearm training platform 6 may determine group performance metrics for the users participating in the group training session. For example, the firearm training platform 6 may determine one or more group performance metrics by processing, for each user participating in the group training session, at least one of: video data, targeting path data, handle grip data, trigger data, metrics data, feedback data, and/or the like. The group performance metrics may include a value indicating an aggregated total, a value indicating an average between the users, and/or the like. In some embodiments, the firearm training platform 6 may rank individual performance metrics for each user participating in the group training session. The group performance metrics and/or the ranked individual performance metrics may be provided to each respective computing device 4 for display on a user interface.

In some embodiments, the firearm training platform 6 may support a referrals system to provide a user with a recommended trainer. For example, the firearm training platform 6 may receive performance and/or feedback data from the computing device 4 and may recommend a coach or trainer based on the location of the user and the data collected and/or determined during a training session. In some embodiments, such as when a local trainer is unavailable or inaccessible, the firearm training platform 6 may recommend a coach or trainer that can provide training via remote communications.

To provide a specific example, the computing device 4 may provide, to the firearm training platform 6, a request for one or more coaches or trainers capable of providing firearm training instruction. The request may include location data of the computing device 4 and/or an account identifier for an account of a user. The firearm training platform 6 may use the account identifier to access to data collected during one or more training sessions performed by a user on the computing device 4, including video data, targeting path data, handle grip data, trigger data, metrics data, feedback data, and/or the like. The firearm training platform 6 may process the data collected during these training sessions to identify a level of expertise of the user and may, based on the identified level of expertise and the location of the computing device 4, select one or more prospective trainers or coaches to recommend to the user. The firearm training platform 6 may provide referral data identifying the one or more prospective trainers or coaches to the computing device 4.

The foregoing disclosure provides illustration and description but is not intended to be exhaustive or to limit the embodiments to the precise form disclosed. Modifications and variations may be made in light of the above disclosure or may be acquired from practice of the embodiments.

Certain user interfaces have been described herein and/or shown in the figures. A user interface may include a graphical user interface, a non-graphical user interface, a text-based user interface, etc. A user interface may provide information for display. In some embodiments, a user may interact with the information, such as by providing input via an input component of a device that provides the user interface for display. In some embodiments, a user interface may be configurable by a device and/or a user (e.g., a user may change the size of the user interface, information provided via the user interface, a position of information provided via the user interface, etc.). Additionally, or alternatively, a user interface may be pre-configured to a standard configuration, a specific configuration based on a type of device on which the user interface is displayed, and/or a set of configurations based on capabilities and/or specifications associated with a device on which the user interface is displayed.

It will be apparent that systems and/or methods, described herein, may be implemented in different forms of hardware, firmware, and/or a combination of hardware and software. The actual specialized control hardware or software code used to implement these systems and/or methods is not limiting of the embodiments. Thus, the operation and behavior of the systems and/or methods were described herein without reference to specific software code—it being understood that software and hardware can be used to implement the systems and/or methods based on the description herein.

No element, act, or instruction used herein should be construed as critical or essential unless explicitly described as such. Also, as used herein, the articles "a" and "an" are intended to include one or more items and may be used interchangeably with "one or more." Furthermore, as used herein, the term "set" is intended to include one or more items (e.g., related items, unrelated items, a combination of related and unrelated items, etc.), and may be used interchangeably with "one or more." Where only one item is intended, the phrase "only one" or similar language is used. Also, as used herein, the terms "has," "have," "having," or the like are intended to be open-ended terms. Further, the phrase "based on" is intended to mean "based, at least in part, on" unless explicitly stated otherwise.

While all the invention has been illustrated by a description of various embodiments, and while these embodiments have been described in considerable detail, it is not the intention of the Applicant to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the spirit or scope of the Applicant's general inventive concept.

What is claimed is:

1. A laser cartridge, comprising:

a motion sensor configured to measure an acceleration of the laser cartridge or an acceleration of a firearm to which the laser cartridge is attached;

a laser diode configured to emit light;

a memory;

a processor, operably coupled to the memory, configured to:

communicate with the motion sensor, communicate with the laser diode such that the laser diode emits a burst of light, and communicate with one or more external devices; and a power source configured to provide power to the motion sensor, the laser diode, the memory, and the processor.

2. The laser cartridge of claim 1, wherein the processor, when executing one or more instructions to communicate with the laser diode, is configured to:

communicate with the laser diode at a first time such that the laser diode emits the burst of light in a manner that intermittently illuminates a target for a first duration, and communicate with the laser diode at a second time such that the laser diode emits the burst of light in a manner that continuously illuminates the target until a stop condition is satisfied.

3. The laser cartridge of claim 1, wherein the processor, when executing one or more instructions to communicate with the one or more external devices, is configured to:

communicate with the one or more external devices via a Bluetooth communication session.

4. The laser cartridge of claim 1, wherein the motion sensor is an accelerometer.

5. The laser cartridge of claim 1, wherein the processor, when executing one or more instructions to communicate with the one or more external devices, is configured to:

communicate with a sensor coupled to a handle of the firearm, and communicate with a sensor coupled to a trigger of the firearm.

6. The laser cartridge of claim 1, wherein the power source includes one or more rechargeable energy-storing devices that are configured for wireless charging.

7. A laser cartridge system, comprising:

a wireless charging station; and the laser cartridge of claim 1.

* * * * *